US011523652B2

(12) United States Patent
Hall et al.

(10) Patent No.: US 11,523,652 B2
(45) Date of Patent: Dec. 13, 2022

(54) HELMET

(71) Applicant: PARK & DIAMOND INC., Brooklyn, NY (US)

(72) Inventors: David Hall, Brooklyn, NY (US); Jordan Klein, Brooklyn, NY (US); Zak Koster, Brooklyn, NY (US)

(73) Assignee: PARK & DIAMOND INC., New York, NY (US)

( * ) Notice: Subject to any disclaimer, the term of this patent is extended or adjusted under 35 U.S.C. 154(b) by 465 days.

(21) Appl. No.: 16/338,569

(22) PCT Filed: Mar. 28, 2018

(86) PCT No.: PCT/US2018/024800
§ 371 (c)(1),
(2) Date: Apr. 1, 2019

(87) PCT Pub. No.: WO2018/183469
PCT Pub. Date: Oct. 4, 2018

(65) Prior Publication Data

US 2019/0307199 A1 Oct. 10, 2019

Related U.S. Application Data

(60) Provisional application No. 62/478,318, filed on Mar. 29, 2017.

(51) Int. Cl.

| | |
|---|---|
| ***A42B 3/12*** | (2006.01) |
| ***A42B 3/32*** | (2006.01) |
| ***A42B 3/06*** | (2006.01) |

(52) U.S. Cl.
CPC ..... *A42B 3/127* (2013.01); *A42B 3/064* (2013.01); *A42B 3/124* (2013.01); *A42B 3/322* (2013.01)

(58) Field of Classification Search
CPC ..... A42B 3/06; A42B 3/065; A42B 3/322; A42B 3/124; A42B 3/127; A42B 3/064;
(Continued)

(56) References Cited

U.S. PATENT DOCUMENTS 3,208,080 A * 9/1965 Hirsch ..... A42B 3/322 2/414
4,064,565 A 12/1977 Griffiths
(Continued)

OTHER PUBLICATIONS

Jan. 10, 2020 Office Action issued in European Patent Application No. 18778207.3.

(Continued)

*Primary Examiner* — Jameson D Collier
(74) *Attorney, Agent, or Firm* — Oliff PLC

(57) ABSTRACT

A helmet of a layered and segmented design including impact attenuation structures may include a series of layers that individually, or in combination, provide the necessary functions of the helmet. The helmet may feature a layer with a low coefficient of friction to act as a slip layer and slide due to rotational force. The present technology includes impact attenuation structures of predetermined geometries, layers, and materials to allow for an appropriate impact response with a certain degree of control over the buckling process and an adaptive impact response. The present technology of impact attenuation structures may be applicable where impact absorption and controlled buckling is desired, such as bike helmets.

17 Claims, 18 Drawing Sheets

(58) Field of Classification Search
CPC ..... A42B 3/063; A42B 3/121; A42B 1/201; A42B 3/00
USPC ..... 2/410–412, 414, 425, 209.11
See application file for complete search history.

(56) References Cited

U.S. PATENT DOCUMENTS

| | | | | |
|---|---|---|---|---|
| 5,012,533 | A * | 5/1991 | Raffler | A42B 3/066 2/420 |
| 5,173,970 | A | 12/1992 | Shifrin | |
| 5,515,546 | A | 5/1996 | Shifrin | |
| 5,540,972 | A | 7/1996 | Jaegers et al. | |
| 5,675,843 | A | 10/1997 | Grim et al. | |
| 5,933,925 | A | 8/1999 | Anscher et al. | |
| 6,245,407 | B1 | 6/2001 | Wang et al. | |
| 6,245,408 | B1 | 6/2001 | Bitzer | |
| 6,381,760 | B1 * | 5/2002 | Lampe | A42B 3/00 2/414 |
| 8,220,072 | B2 * | 7/2012 | Dodd | A41D 13/0543 2/22 |
| 8,316,468 | B2 | 11/2012 | Skottheim et al. | |
| 8,739,316 | B1 | 6/2014 | Norton | |
| 8,961,733 | B2 * | 2/2015 | Dodd | A41D 13/0506 156/290 |
| 8,978,165 | B2 * | 3/2015 | Franco | A42B 3/0406 2/244 |
| 2008/0172779 | A1 | 7/2008 | Ferguson | |
| 2013/0191972 | A1 * | 8/2013 | Woolf | A42B 3/322 2/410 |
| 2013/0305435 | A1 | 11/2013 | Surabhi | |
| 2014/0215694 | A1 | 8/2014 | Grice | |
| 2015/0047109 | A1 | 2/2015 | Grant et al. | |
| 2016/0353825 | A1 | 12/2016 | Bottlang et al. | |

OTHER PUBLICATIONS

Jul. 17, 2020 Office Action issued in European Patent Application No. 18778207.03.
Aug. 8, 2018 International Search Report issued in International Application No. PCT/US2018/024800, 4 pages.
Aug. 8, 2018 Written Opinion issued in International Application No. PCT/US2018/024800, 7 pages.
"Visor problems and some good experience," [Retrieved from http://www.bhsi.org/visors.htm on Mar. 20, 2019], 8 pages.
Abstract of McGoldrick et al. "Acute traumatic spinal injury following bicycle accidents: a report of three cases." Jun. 2012, 78(3):409-13 [Retrieved from https://www.ncbi.nlm.nih.gov/pubmed/22822586 on Mar. 20, 2019], 1 page.
Extended European Search Report issued in European Application No. 18778207.3 dated Jul. 24, 2019.
Sep. 3, 2021 Office Action issued in Chinese Application No. 201880003906.5.
Jan. 5, 2022 Office Action issued in Chinese Application No. 201880003906.5.
May 20, 2022 Partial European Search Report issued in European Application No. 21206050.3.
Mar. 17, 2022 Office Action issued in Chinese Application No. 201880003906.5.

* cited by examiner

HELMET

This application is the U.S. national phase of International Application No. PCT/US2018/024800 filed Mar. 28, 2018, which designated the U.S. and claims priority to U.S. Provisional Application No. 62/478,318 filed Mar. 29, 2017, the entire contents of each of which are hereby incorporated by reference.

BACKGROUND

A helmet is a piece of protective headwear that provides impact absorption for a portion of the head. Helmets are used in many different applications, including industry, sports, medicine, and military. The broad range of use cases results in helmets being offered in a range of sizes, materials, shapes, and degrees of protection. Perhaps the most well-known helmet is the construction hardhat that construction workers are often required to wear on hazardous construction sites. A construction helmet is typically a single rigid structure including a shell of high-density polyethylene that has been shown to provide protection in the event of impact from falling objects and collisions on the work site.

Many helmets rely upon a layer of foam between the rigid structure and the user's head to provide additional impact absorption and protection. Certain applications, such as cycling, motorcycling, skiing, and ice hockey require the additional impact absorption, which can be provided from the foam layer. The material is typically expanded polystyrene (EPS) foam that is usually grey or white in color and rigid once formed. This creates a thick layer with many applications requiring about an inch thick of foam in many locations. The core purpose of a typical helmet is to protect a portion of the user's head, and many helmets rely upon a rigid shell and bulky foam layer.

A helmet can experience different types of impacts; radial impacts are rare and result in the head accelerating in a translational motion. In addition, a tangential hit to the helmet with a pure angular acceleration for the head is rare. The most common type of impact is a combination of radial and tangential impacts, called oblique impacts. This type of acceleration results in the brain rotating within the skull which can result in injury to the brain and the spinal cord. Large conventional helmets, such as those worn for cycling, ice hockey, and equestrian riding, have a thick shell that extends the point of contact further from the center of the head or spinal cord in an impact, resulting in a greater moment arm and therefore a greater rotational tendency for the head.

U.S. Pat. No. 4,064,565 titled Helmet Structure issued May 13, 1976 exemplifies a typical helmet design. Note that the patent states "at least the majority of helmet designs include a stiff, inflexible outer shell . . . ", and presents a helmet that incorporates this typical structure.

Honeycomb structures have been implemented in applications from aerospace to shipping and packing material. Honeycomb structures offer the unique advantage of high strength and a minimal weight, essential for many applications such as aircraft. Honeycomb structures can include many different materials, including metals such as aluminum, thermoplastics such as polycarbonate, and composite materials such as resin impregnated fibers and papers. Each material is ideal for certain applications; aluminum honeycomb is often used for large impact attenuation structures, such as crash structures on racecars. Thermoplastic honeycomb is often selected for packing material due to low cost per volume. The resin impregnated fibers and papers honeycomb often consists of phenolic resin for flame retardancy and dielectric properties for military and electrical applications. Metallic honeycombs such as aluminum and stainless steel are selected for very high stiffness.

Many honeycombs are processed by being "pre-stressed" before being applied in order to initiate buckling without a large peak acceleration. Honeycomb structures typically consist of an array of cylindrical or hexagonal columns that must begin buckling before absorbing a significant amount of impact energy. For certain material types, such as aluminum honeycomb, there must be a considerable amount of energy applied before buckling starts. Fiber honeycombs will typically initiate buckling well before metallic honeycombs, but force applied before buckling often results in a peak of acceleration for the impact scenario. This peak can be very harmful in certain applications such as safety barriers and personal protective equipment where the peak of acceleration before buckling results in increased chance of damage or injury.

Impact absorbing structures such as honeycomb structures often exhibit highly nonlinear responses to impacts. The process of initiating buckling and then the process of buckling can be highly unpredictable, resulting in uncontrolled situations that can make optimizing the impact absorbing structures for certain applications a challenge. In addition, many impact absorbing structures do not adaptively respond to the type of force that is applied. In other words, the structure will respond at a proportional rate to the applied load, often meaning that a larger force results in a proportionally faster deformation. The two phenomenon of nonlinear and non-adaptive impact responses can limit the application and efficacy of impact absorbing structures such as honeycomb structures.

U.S. Pat. No. 6,245,407 titled Thermoformable Honeycomb Structures issued Jun. 12, 2001 exemplifies a typical honeycomb structure and production.

U.S. Pat. No. 5,540,972 titled Prestressed Honeycomb, Method and Apparatus Therefor issued Jul. 30, 1996 exemplifies a typical prestressed honeycomb and manufacturing process.

SUMMARY

The present technology relates to a helmet, and more particularly, a protective piece of headwear of a layered and segmented helmet suitable for sporting, industrial, medical, and military applications.

The conventional approach towards helmet design has relied upon a rigid structure, referred to as the "shell," for impact absorption. Many helmets require a layer of foam that is typically an inch thick in most areas and forms a rigid layer between the shell and the user's head, and results in a large and bulky form factor with an unappealing aesthetic. These and similar drawbacks may cause people to not wear a conventional helmet. The proposed technology addresses these failure points by offering a protective piece of headwear of a reduced volume with a segmented and layered design.

The proposed technology may comprise a series of layers that individually, or in combination, provide the necessary functions of the helmet (e.g. protection) with many benefits when compared to a conventional helmet. The number of layers may be dependent upon the specific application and the customization of the user. The layers can be changed to meet the need and preference of the user, provided that the integrity and necessary functions of the helmet are maintained. A helmet of three layers will be considered as an example. The inner layer, the layer closest to the head while in use, can be customized to provide the ideal amount of comfort foam, heat regulation, and/or perforation pattern, and may be removed and washed, or replaced for hygienic purposes. The middle layer may include the impact attenuation material and can include contact points for the retention system to connect or can integrate a retention strap into the layer. The interchangeable retention system can allow for the user to select a strap that is the most comfortable and stylish for them. All of the layers may feature certain properties and treatments such as anti-microbial treatments to reduce odor, moisture wicking properties to remove perspiration from the skin to cool the user, and UV protection to protect the user and the underlying layers of the helmet from UV radiation, and hydrophobic treatments to protect the user and the underlying layers from environmental moisture.

The middle layer can provide impact attenuation, and may determine the form-factor of the helmet, and a segmented design can provide flexibility that allows the helmet to stretch to fit various sizes to heads comfortably. The outer layer, the layer furthest from the head while in use, can provide the aesthetic of the helmet and can incorporate a visor and/or additional aesthetic detail. In addition, the outer layer may include selected material and/or perforation patterns that may provide improved ventilation for comfort, improved aerodynamics for performance, or material for aesthetic appeal. A layer, multiple layers, or the retention system can house individually, or with other layers of the helmet, passive or active powered electronic systems for identification, monitoring, and similar applications.

In addition, the layers may include a material with a low coefficient of friction with respect to one another to allow the layers to slide on top of each other. This sliding effect allows the layers to "slip" and reduce the frictional effect on the helmet in the event of an impact, which can reduce the rotational energy experienced by the user during an impact. The present technology can offer improved comfort, ventilation, convenience, style, hygiene, and protection when compared to conventional helmets. The proposed technology can be customized to fit the user's taste and lifestyle so that there is no longer an excuse to not wear a helmet.

The proposed technology may feature a segmented design that allows the helmet to be manipulated into alternative form factors for greater portability and a form-fitting design for improved comfort when compared to a conventional helmet. The form factor of the helmet is the physical size and shape of the complete product. The segmented design may incorporate a system of rigid and flexible components. Rather than a stiff, bulky outer shell and foam layer, the proposed technology may include rigid or semi-rigid impact attenuating structures which may be connected via flexible connectors.

The proposed technology may include a honeycomb structure with a cell wall that has a hydrophobic coating. The hydrophobic coating can protect the inner material, often a hydrophilic substance such as aramid fibers, from environmental conditions that could degrade the structural integrity. In addition, the hydrophobic coating could provide rigidity to a pre-stressed honeycomb to protect the structure from small impacts, such as those experienced from handling the product, while allowing for the pre-stressed honeycomb to exhibit a reduced peak acceleration during impacts. The proposed technology may also include a honeycomb structure with a cell wall consisting of a series of layers with varying densities. The outside layers of the cell wall may provide a significant portion of the strength of the structure during load, deformation strain, and energy absorption because they are geometrically set at the ends of the cross section that undergoes more deformation per panel strain radius while the less dense core material in the middle may reduce the overall weight of the structure that would otherwise not significantly contribute to strain energy absorption. A significant portion of the honeycomb structure strength deformation energy potential may be maintained or improved with the possibility of significantly reducing the overall structure weight. The proposed technology may include a honeycomb structure with a manipulated cell wall to improve the impact response of a honeycomb cell during buckling. The cell wall can have a varying density or thickness throughout the length of the cell wall.

The present technology may include a honeycomb structure with a manipulated cell wall to improve the impact response of a honeycomb cell during buckling. The cell wall can have a varying density or thickness throughout the length of the cell wall. The thinner portion may buckle before the thicker portion, providing a controlled and predictable buckling for reducing rebound elastic energy and optimizing across various impact energies. Buckling may be initiated earlier by having the top portion immediately buckle, reducing the peak acceleration that occurs as the result of applying load until critical buckling occurs, while the remaining thicker structure can provide the remaining impact attenuation. If an extrusion process is slow enough, one may control the temperature to a large degree and cool the honeycomb as it is extruded. This cold works the material more and more inducing residual stresses the colder the honeycomb is extruded towards the end to make the cell unstable and prone to buckling to reduce the stress riser from a first critical buckle and eliminate the need for pre-crushing of the honeycomb.

The present technology may include a composite panel that is thermally adhered to the top and/or bottom of an individual honeycomb cell or a plurality of honeycomb cells. The present technology may include selecting the thermoplastic materials with effective melting points and densities to ensure a bond. Manufacturing may include having the composite sheet underneath the honeycomb so that during the bonding process, the outer layer of the composite softens to allow the honeycomb cell walls to sink into the composite panel layer creating a meniscus effect and improving the bond in a way that is more reliable and predictable when compared to bonding with the panel on top.

The present technology may include a honeycomb structure that can adaptively respond to the energy of impacts. The honeycomb structure may include a sealed panel on the top and on the bottom of the honeycomb ends. A honeycomb cell may include a sealed panel on the top and bottom with a single or multiple perforation(s) that may be on the top, bottom, or both. The perforation, or orifice, may allow for the movement of fluid due to a change in inner volume of the structure from an impact crumpling and locally buckling the structure. The fluid inside the cell, which can be Newtonian or non-Newtonian, responds to the change in volume of the cells with the relative impact velocity and corresponding kinetic energy as the fluid exits the orifice(s). The faster the attenuation, the faster the liquid or gas inside of the cells is pushed out and the more corresponding energy the gas or liquid has, thus creating an optimal deceleration curve for a given impact energy. The impact is now adaptive, controlled by the ratio of the cell cross-sectional area to the ratio of the orifice areas. Similarly, the proposed technology can include a single or multiple perforations along the cell wall and the impact response may be controlled by the ratio of the cell cross-sectional area to the ratio of the orifice areas. However, the proposed technology differs from the previously mentioned technology since the structure may allow for a changing orifice area with relation to the portion of the cell that is crushed. During the crushing process, the orifice that is activating the buckling due to being a local stress riser will close as the surrounding cell wall area collapses in on the opening, thus closing the orifice. Multiple perforations along a cell wall may compensate for an adverse decrease in impact force by closing off some orifices as buckling propagates through the cell and closes orifices one at a time. When each consecutive orifice closes, the collective orifice area decreases, thereby increasing the energy and speed of the exhausted fluid, stiffening slightly the air adaptive effect and compensating for the effect decreasing as a helmet decelerates. The perforations along the cell wall of the honeycomb may also create stress risers that provide weak spots during loading, which may allow for a way to predict and control the buckling response, an inherently unpredictable behavior.

DETAILED DESCRIPTION

The following description is provided in relation to several examples which may share common characteristics and features. It is to be understood that one or more features of any example may be combinable with one or more features of the other examples. In addition, any single feature or combination of features in any of the examples may constitute additional examples.

Figure 1:
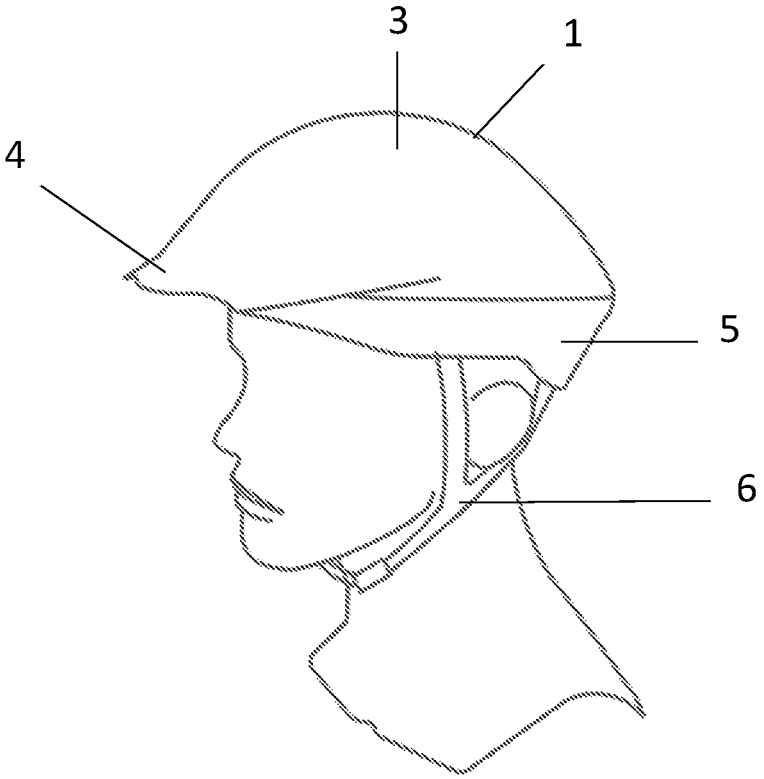
FIG. 1 is a perspective view of a traditional cycling helmet.

FIG. 1 is a perspective view of a traditional cycling helmet 1. The conventional approach towards helmet design has often relied upon a rigid structure, which includes the shell 3 and the foam layer 5, for impact absorption. The traditional bike helmet 1 can include a visor 4 and is required to have a strap 6, both of which must follow the US Consumer Product Safety Commission regulations for bicycle helmets. Bicycle helmets are selected as an example to show how current helmet design, for many applications and users, has resulted in form factors that are often described as large and bulky with an unattractive aesthetic. In addition, the rigid nature of the foam layer 5 and shell 3 has often contributed to users feeling that helmets are uncomfortable to wear. Often, many individuals who are participating in a sporting activity, working on an industrial site, and/or active in a military role have chosen to not wear a helmet due to the current drawbacks of conventional helmet design despite knowing the inherent risk of the activity.

Figure 2:
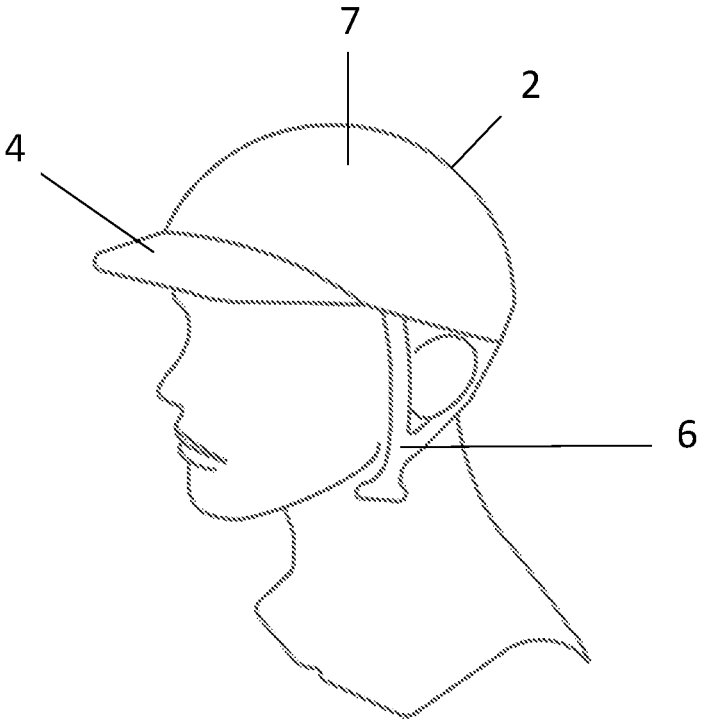
FIG. 2 is a perspective view of a helmet according to an example of the proposed technology.

FIG. 2 is a perspective view of a helmet 2 according to the present technology, and can feature a visor 4 and strap 6 similar to the traditional cycling helmet 1. However, the visor 4 can include a flexible material in order for the visor to change shape when the helmet 2 is being manipulated into alternative form factors. The strap 6 of the helmet 2 can be permanently integrated into the helmet 2 or be attached in such a way that the strap 6 is removable and replaceable. This allows the user to select the appropriate strap 6, and replace a worn strap for optimal performance and safety. The visor 4 and strap 6 of the helmet 2 preferably follows all of the legally required regulations for the corresponding safety application. The helmet 2 includes a series of layers, with the outer layer 7 shown. Further details of the series of layers, segmented design, and materials are listed below. Note the reduced volume (i.e. the amount that the helmet projects away from the user's head) of the advanced helmet 2 when compared to the traditional cycling helmet 1 in FIG. 1. The reduced volume of the helmet 2 may allow the helmet to have a minimized profile for a more aesthetically pleasing design when compared to the traditional cycling helmet 1 and many other conventional helmet designs. In addition, the covered segmented design, not shown in FIG. 2, can allow for the helmet 2 to be manipulated into alternative form factors for improved portability.

The present technology may include tailored impact attenuation structures to achieve impact absorption with proper performance, as described below. Segmented impact tiles 11, shown in FIG. 5, rather than a continuous body of impact attenuation material can be used to conform a rigid or semi-rigid material to complex shapes, such as body parts. The impact attenuating tiles are shown in a substantially triangular shape, as characterized by three sides with rounded vertices. The tiles can be any prism of three sides or more in order to create an array of tiles to cover the appropriate area. Circular prisms have been found to be less preferable due to leaving large exposed areas between tiles. Shapes with straight edges are preferable to allow for bending along predetermined directions, whereas circular shapes may not have this advantage and may have inconsistent gaps due to curvature. In addition, straight edges are often easier to manufacture, and simple shapes such as triangles can allow for modularity and repeatability.

Figure 3:
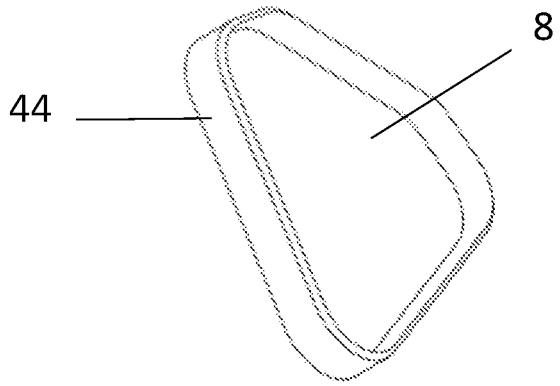
FIG. 3 is a perspective view of an exemplary bottom layer of an impact tile with a triangular geometry.
Figure 4:
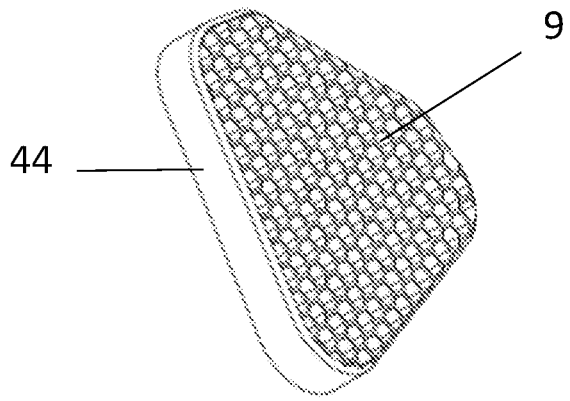
FIG. 4 is a perspective view of an exemplary bottom layer of an impact tile containing a honeycomb-like impact absorbing material with a triangular geometry.
Figure 5:
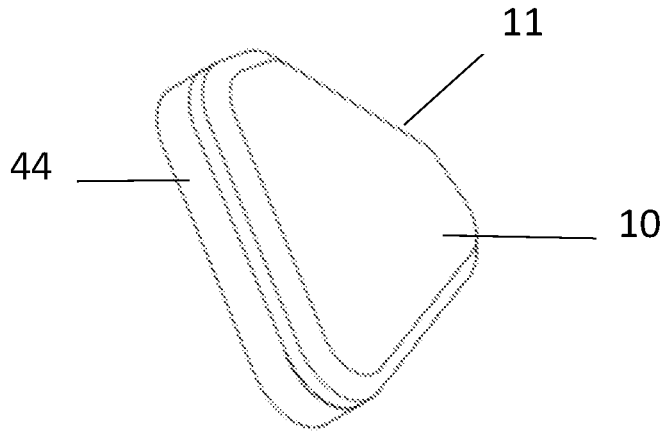
FIG. 5 is a perspective view of an exemplary full impact tile with a bottom and top layer containing a honeycomb-like impact absorbing material with a triangular geometry.

Impact attenuating structures, such as honeycomb, can be applied to the tile in applications where energy absorption is desired with the possibility of a controlled and/or adaptive impact response. Further detail of impact attenuating structures with controlled and/or adaptive impact responses are below. FIG. 5 is a perspective view of an impact tile 11 with an impact tile top 10 and impact tile base 8. The impact tile 11, including the base 8, impact layer 9, and top 10, may be a single material or a composite of materials, and the size, shape, and any openings will depend upon the helmet size and application. The material selected will depend on the constraints of the specific application, such as the allowable thickness of the helmet, desired ventilation, weight of the product, and other possible considerations. FIG. 3 is a perspective view of the impact tile base 8 and FIG. 4 is a perspective view of an impact tile base 8 containing a honeycomb-like impact absorbing layer 9. For example, if minimal thickness with ventilation is desired, a pre-crushed aramid fiber and/or thermoplastic honeycomb structure may provide suitable impact absorption and open geometry allows for ventilation.

For FIG. 3 and FIG. 5, note that the impact layer base 8 may or may not include a wall 44 to connect the impact tile base 8 to the impact tile top 10. The wall 44 may enclose the impact absorbing layer 9 and may create a seal. Certain materials such as aramid honeycomb and hydrophilic materials may exhibit superior performance when sealed. The wall 44 of the impact layer base 8 may also contribute to the impact absorption for certain materials, such as honeycomb structures that are most efficient when buckling from forces applied parallel to the columns. The wall 44 for the impact layer base 8 can assist with the column buckling by effectively guiding the columns to buckle along the longitudinal axis. FIG. 3 and FIG. 5 show an arbitrarily selected height for the impact tile. The appropriate height will depend upon the specific application and the selected impact absorbing material.

Figure 6:
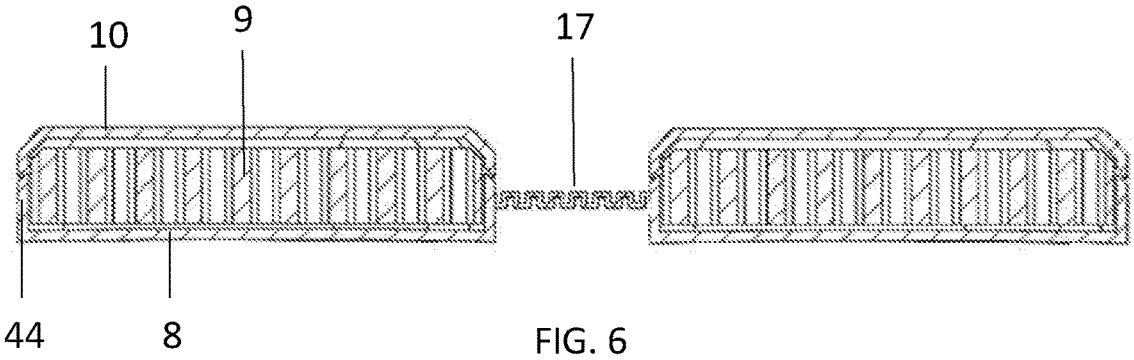
FIG. 6 is a side view of two exemplary connected impact tiles with triangular geometries containing impact absorbing material.
Figure 7:
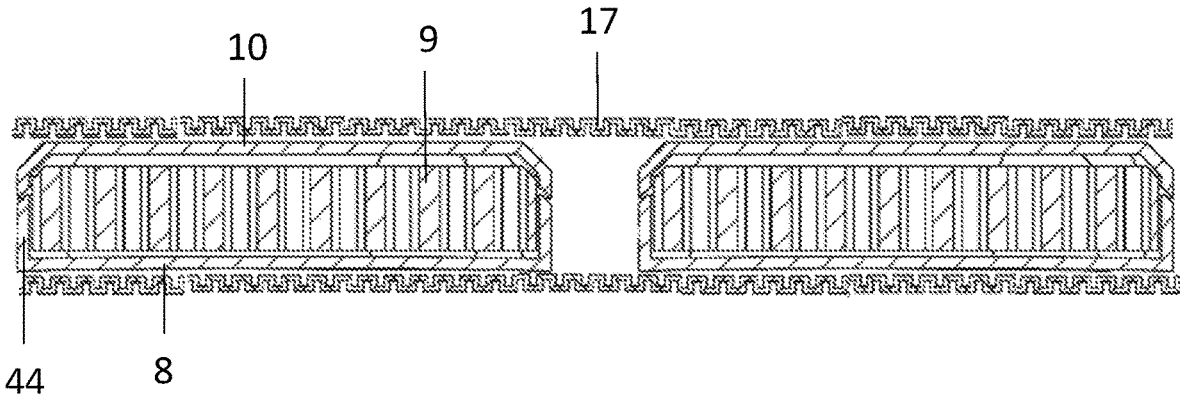
FIG. 7 is a side view of two exemplary connected impact tiles with triangular geometries containing honeycomb-like impact absorbing materials with connectors on the top and bottom.
Figure 8:
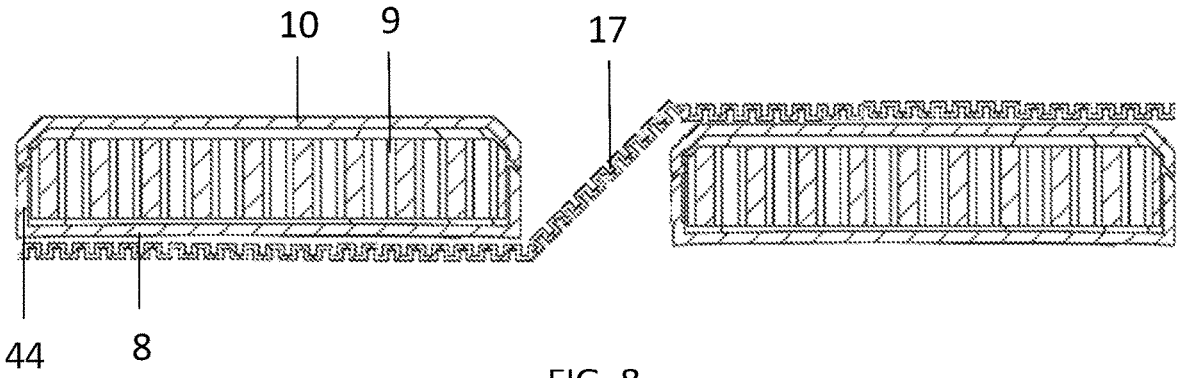
FIG. 8 is a side view of two exemplary connected impact tiles with triangular geometries containing honeycomb-like impact absorbing materials with connectors running from the top of one tile to bottom of the other tile.

The proposed technology is preferably capable of being manipulated into alternative form factors which may achieve greater portability. FIGS. 6, 7, and 8 show possible combinations for connecting the impact tiles 11 to each other in order to form an array. FIG. 6 is a side view of the cross section of two connected impact tiles 11 with triangular geometries, including the impact tile base 8, impact layer 9, and impact tile top 10. Note the connector 17 attached to each impact tile 11 to create an array of tiles. The connector 17 may include inelastic material, such as an inelastic fabric, or highly elastic material, such as silicon, to provide a connection that does not substantially hinder the bending motion of the array of impact tiles 11. The flexible connector 17 may allow for improved flexibility of the array of impact tiles, therefore allowing the array of impact attenuating structures to conform to the body for improved comfort and protection, when compared to a conventional helmet. In addition, the flexible connectors may allow the helmet to be manipulated into alternative form factors for storage and transportation. The distance between the impact tiles 11 within the array may vary depending on the size of the equipment and the specific applications. The material of the connector may be inelastic in order to prevent the connectors from expanding too far during an impact, essentially being pushed away from the center of the impact and resulting in a diminished impact absorption. The material of the connector may also be a combination of elastic and inelastic materials. Such a combination may be configured so that the elastic material allows for some expansion of distance between adjacent tiles but expansion is also limited when slack in the inelastic material is taken up by the expansion.

FIG. 7 is a side view of the cross section of two connected impact tiles 11 with triangular geometries, including the impact tile base 8, impact layer 9, and impact tile top 10. The impact tiles 11 may be adhered or bound to the flexible connectors 17 on the top and bottom of the impact tiles 11. This is an alternative method of connecting the impact tiles 11 to form an array, and the connectors 17 could be the flexible fabric of the protective element. FIG. 8 is a side view of the cross section of two connected impact tiles 11 with connectors 17 running from the top of one tile 11 to bottom of the other tile 11. The different methods for attaching the connectors 17 to the impact tiles 11 may have different advantages. Attaching the connectors 17 to the walls of the impact tile, as shown in FIG. 8, may provide additional impact absorption depending on the selected material, but may also hinder the bending motion relative to other options. The connectors 17 can also be integrated within the impact tiles 11 to provide impact attenuation and connect each impact tile. The integrated connector may resemble a standard connector 17 in the sense of spanning the gap between tiles 11, however it would be a layer of material within the impact tile 11. FIG. 8 may be the most advantageous for sections of the helmet that require large amounts of bending, since having the connectors 17 connect from one top face 10 to the other tile's bottom face 8 may provide a large amount of bending in certain directions. The selection of which connector attachment style may be dictated by the size and application of the helmet, each connector attachment style may be used at different locations of the helmet to satisfy different requirements of a given location of the helmet.

Figure 9:
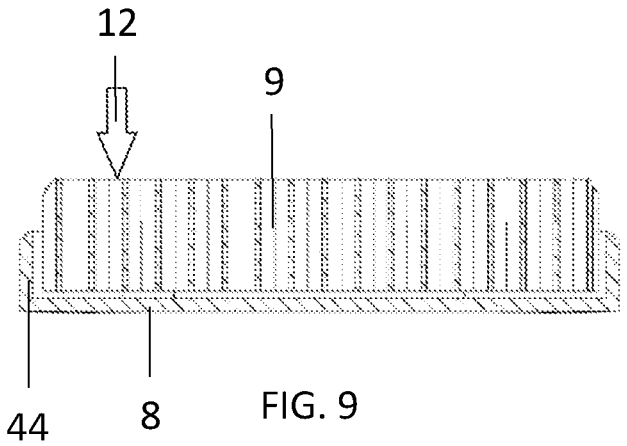
FIG. 9 is a cross section of a side view of an exemplary impact tile containing a honeycomb-like impact absorbing material being impacted without a top layer.
Figure 10:
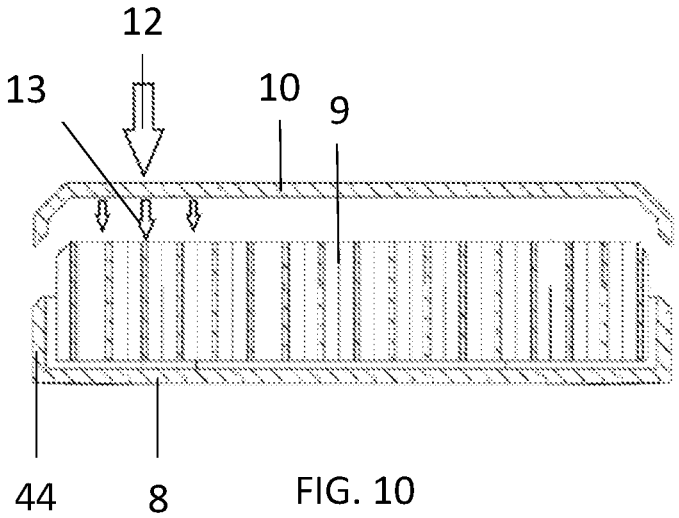
FIG. 10 is a cross section of a side view of an exemplary impact tile containing a honeycomb-like impact absorbing material being impacted where a top layer is included.

The impact tile base 8 and the impact tile top 10 may be included with the impact layer 9 as a form of point-load distribution for greater impact energy absorption. FIG. 9 is a cross section of a side view of an impact tile base 8 and impact layer 9 being impacted by a point load 12. A point load is when a force acts on a small area, often referred to as a point. A typical scenario for a point load 12 occurring would be an athlete or hospital patient falling and their head colliding with the ground, or an activity involving projectiles such as baseball and the projectile impacting the helmet. The point load 12 only contacts a small area of the impact layer 9, and results in only a small portion of the impact layer 9 absorbs the energy of the impact. FIG. 10 is a cross section of a side view of an impact tile base 8, impact layer 9, and impact tile top 10 being impacted by a point load 12. The distance from the impact layer 9 and impact tile top 10 is exaggerated to show the resulting dispersed force 13. The impact tile top 10 may engage the point load 12 by absorbing a portion of the impact and dispersing the remaining force to impact layer 9 and impact tile base 8. The dispersed force 13 may act on a larger area when compared to the point load 12 in FIG. 9, which may require less impact absorbing material which may result in greater impact absorption in a reduced volume when compared to the traditional cycling helmet 1 in FIG. 1 and other conventional helmets. This method of achieving impact attenuation will be referred to as "internal point-load distribution."

Figure 11:
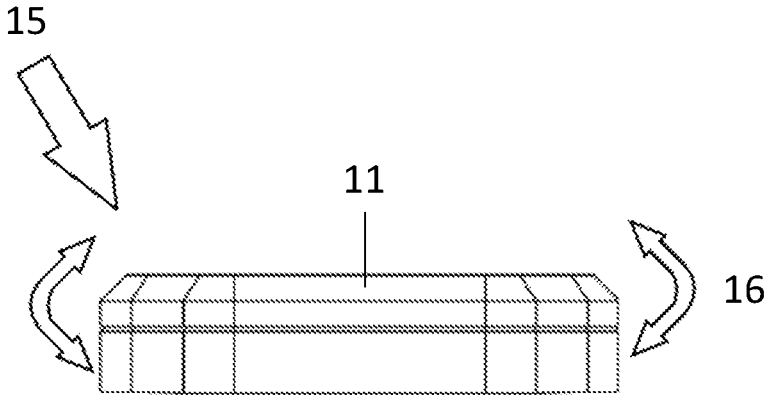
FIG. 11 is a side view of an exemplary pivot tile with an applied load.

The internal point-load distribution is complemented by another aspect of the present technology, referred to as "internal rotational-load distribution." The force applied to a helmet during impact may cause rotational motion to the helmet and the head, which can increase the chance of injury. A system of joints may be provided to allow limited rotational motion within the impact tile that may reduce the rotational forces applied to the head during impact. FIG. 9 is a side view of the cross section of the impact tile base 8, and shows the platform and walls of the base layer. FIG. 11 is a side view of a tile 11 with an applied load 15 which may result in the top layer 10 pivoting to create a rotational motion 16. In the event of an oblique impact (i.e. an impact that is not applied normal to the head and helmet), the helmet and head may react to the force by rotating about the spinal cord. The rotational motion may be a leading cause for traumatic brain injury and spinal cord injury, and the internal rotational-load distribution may reduce such rotational effect. The top layer 10 may rotate while secured on top of the tile 11, resulting on a rotational motion 16 that may reduce the rotational energy transmitted to the head.

Figure 13:
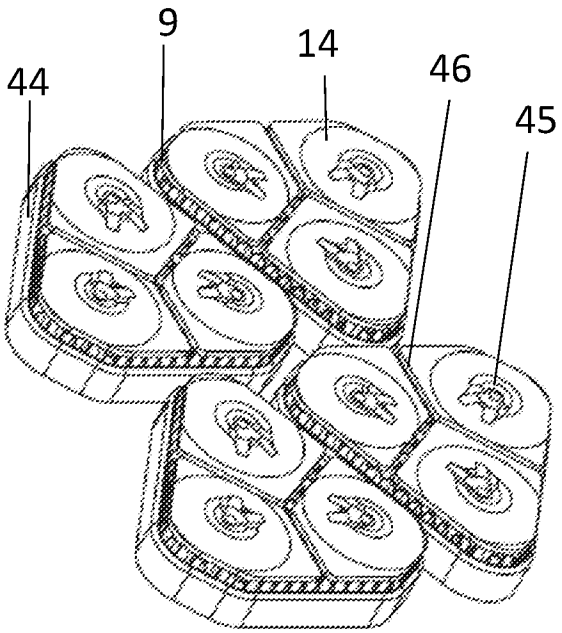
FIG. 13 is a perspective view of an exemplary pivot tile with a triangular geometry and without the top layer.
Figure 12:
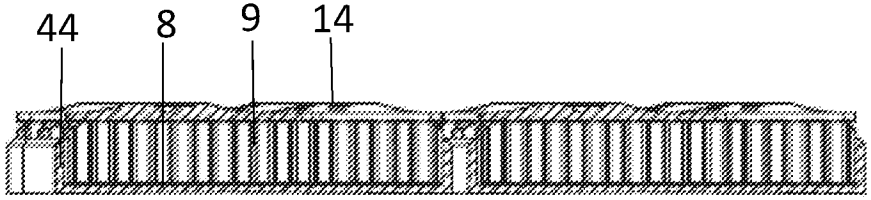
FIG. 12 is a cross section view of an exemplary pivot tile without the top layer with a triangular geometry.

FIG. 12 is a side view of the cross section of the impact tile base 8, impact layer 9, and socket layer 14 with a triangular geometry. FIG. 13 is a perspective view of the cross section of the impact tile base 8, impact layer 9, and socket layer 14 with a triangular geometry and shows the relative relationship between the three layers. The impact layer 9 is preferably contained within the base layer 8, and the socket layer 14 is preferably the appropriate size to be supported by the impact tile base 8. If the socket layer 14 is too large, then the walls of the base layer 8 will be in contact with the socket layer 14 and absorb the applied load rather than the impact layer 9 and may hinder the rotational motion of the joints. However, if the socket layer 14 is too small, the socket layer may not disperse the applied load across the entire top surface area of the impact layer 9. The top layer 10 includes the male connection(s) (e.g. ball end) of the ball and socket joint. The socket layer 14 includes the female connection(s) 45 (e.g. socket, best viewed in FIG. 13) and may feature geometric and topological modifications to alter the rotational response of the tile. Grooves 46 are shown in FIG. 13 which start from the socket joints and are directed towards the center area of the tile 11. Three grooves are illustrated for each socket layer 14, dividing the socket layer 14 into three sections, but any number of grooves may be included as necessary for a given tile configuration and/or desired impact response. During rotation, the grooves may direct the rotation of the ball and socket joint along the grooves and towards the center of the tile 11. Such movement may be preferable since it may result in the impact rotating towards the center of the tile 11 which may improve the impact attenuation when compared to the impact occurring near the edges of an array of tiles.

Figure 15:
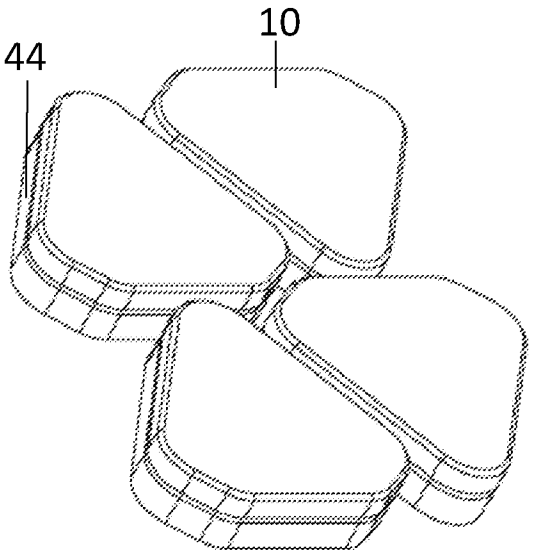
FIG. 15 is a perspective view of an exemplary pivot tile with a triangular geometry and with the top layer.
Figure 14:
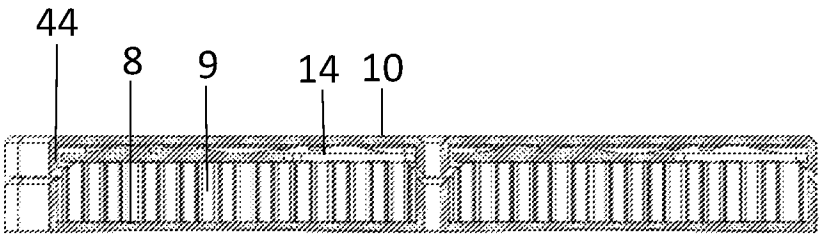
FIG. 14 is a cross section view of an exemplary pivot tile with a triangular geometry and with the top layer.

FIG. 14 is a side view of the cross section of the base layer 8, impact layer 9, socket layer 14, and top layer 10 of an impact tile 11 with a triangular geometry. FIG. 15 is a perspective view of the cross section of the base layer 8, impact layer 9, socket layer 14, and top layer 10 of an impact tile with a triangular geometry and shows the relative relationship between all four layers. The top layer 10 is preferably the appropriate size to properly interact with the three other layers. If the top layer 10 is too large, the pivot tile may not be able to occupy the proper form factor. If the top layer 10 is too small, it may not be able to form proper ball-and-socket joints with the socket layer 14. The ball-and-socket connections between the top layer 10 and the socket layer 14 may allow for additional internal point-load distribution.

FIG. 15 is a side view of an impact tile 11 with a triangular geometry with a force, shown by arrow 15, acting on the tile showing the internal rotation load distribution, as shown by arrows 16. The evenly spaced joints allow for an applied point load to be distributed across all of the joints, therefore dispersing the force across the entire top surface area of the impact material to improve the impact absorption, another form of internal point-load distribution. The internal rotational load distribution is due to the limited rotational motion of the ball-and-socket joints allowing for the top plate or plates to rotate, as shown by arrows 16, which may reduce the applied rotational force.

Figure 16:
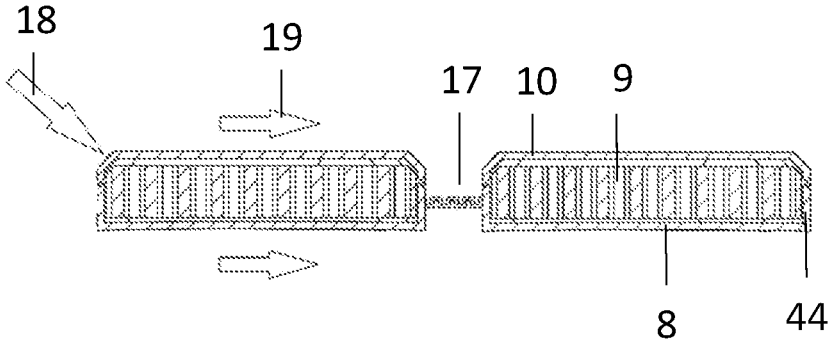
FIG. 16 is a side view of two exemplary connected impact tiles with a force acting on the left tile to show the external point load distribution, both containing honeycomb-like material.

FIG. 16 is a side view of the cross section of two connected impact tiles with triangular geometries, including the impact tile base 8, impact layer 9, and impact tile top 10. A force, as indicated by arrow 18, is acting on the left tile to show the point-load distribution. The left tile is contacted by an impact, arrow 18, and translates to the right, the movement shown by arrow 19, and is damped by the flexible connector 17. The translational movement distributes force from the left tile to the right tile, thus increasing the surface area of the applied impact and increasing the impact absorption of the protective equipment. External point-load distribution may be achieved by distributing the applied force 18 to the connectors 14 and the other impact tile 11. In addition, external rotation-load distribution may be achieved by absorbing the rotational force in the translation of the left tile, the connectors 14 resisting the rotational motion, and the right tile consequently moving as well.

Figure 17:
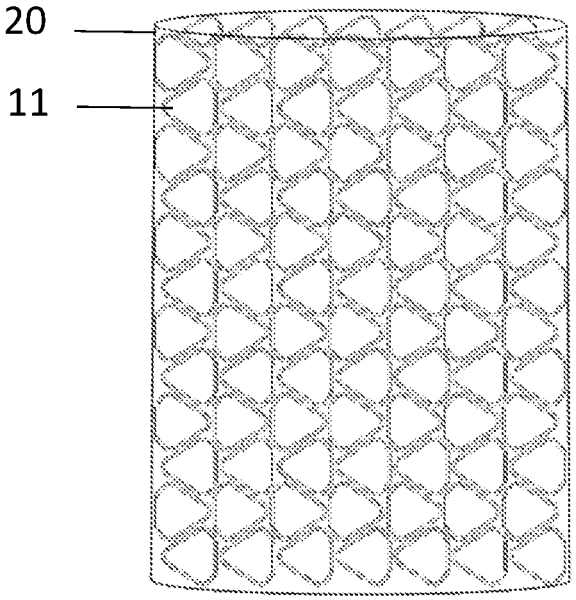
FIG. 17 is a front view of an exemplary helmet including connected impact tiles rolled up into a cylindrical shape.
Figure 18:
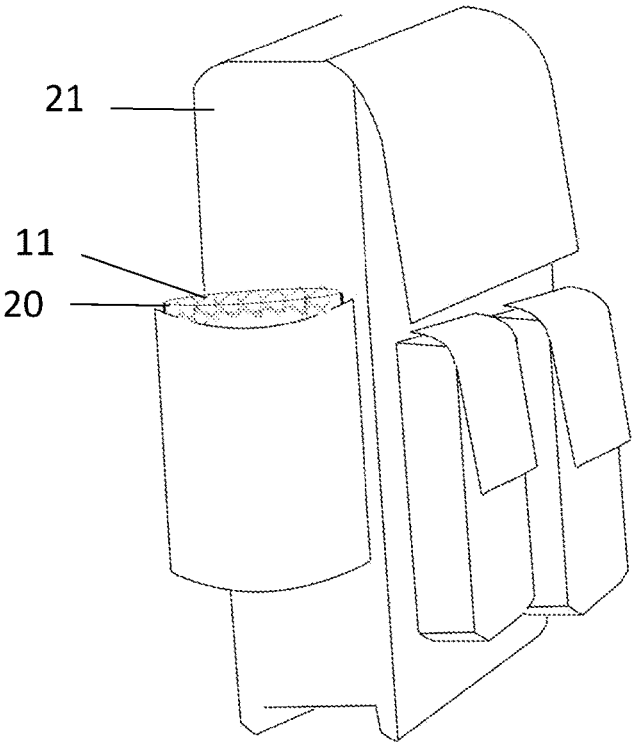
FIG. 18 is a perspective view of an exemplary helmet including connected impact tiles rolled up into a cylindrical shape and placed in the bottle holder of a briefcase.

FIG. 17 is a front view of an array 20 of connected impact tiles 11 rolled up into a cylindrical shape, showing the flexibility of the array due to the flexible connectors 14. FIG. 18 is a perspective view of an array of connected impact tiles 11 with triangular geometries rolled up into a cylindrical shape and placed in the bottle holder of a briefcase 21. The substantially cylindrical shape may include having the helmet roll up with the appropriate array of tiles 11 to allow for the helmet to occupy the alternative form factor. Additional form factors, such as folding the helmet flat may be allowable with the appropriate tile array. The array is connected with connectors 20, and the equipment is suitable for applications that require impact absorption and value portability, ventilation, minimal weight, and can incorporate exposed areas, such as sports helmets, industrial uniforms, and military equipment. In the case of the present technology being adopted to the cycling industry, a rider could store the helmet in a water bottle holder mounted on the bike or with the rider in their backpack or briefcase water bottle pocket. The improved portability may allow the helmet to be either carried conveniently or stored on the bike, so the helmet may be easily available for use.

Figure 19:
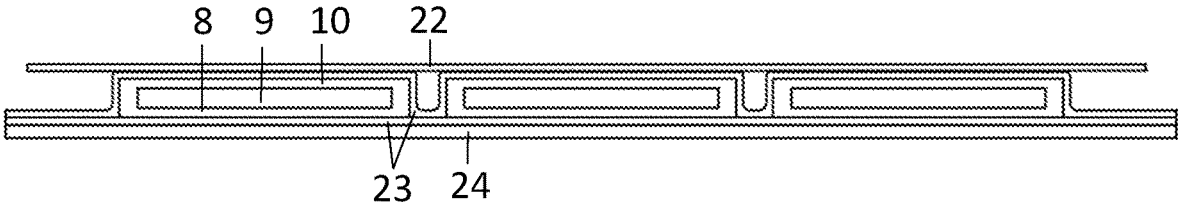
FIG. 19 is a cross section view of an exemplary layered design including three layers.

The present technology may include a series of layers that individually, or in combination, provide the necessary functions of the helmet with an improved user experience. The number of layers may be dependent upon the specific application and the customization of the user. The layers can be changed to meet the need and preference of the user, provided that the integrity and necessary functions of the helmet are maintained. A helmet including three layers is one described example. FIG. 19 is a side view of the cross section of a layered design with three layers. The inner layer 24, the layer closest to the head, can be customized to provide the differing amounts of comfort foam, heat regulation, perforation pattern and can be removed and washed, or replaced for hygienic purposes. The middle layer 23 includes the impact attenuation material and can include contact points for the retention system 25 to connect or can integrate the retention strap 6 into the layer. The interchangeable retention system 25 can allow for the user to select a strap 6 that is the most comfortable and stylish for them. The middle layer 23 can provide the impact attenuation, and would determine the form-factor of the helmet, and the segmented design can provide flexibility that allows the helmet to stretch to fit various sizes of heads comfortably. The middle layer 23 may contain the impact tile base 8, impact layer 9, and impact tile top 10.

Figure 20:
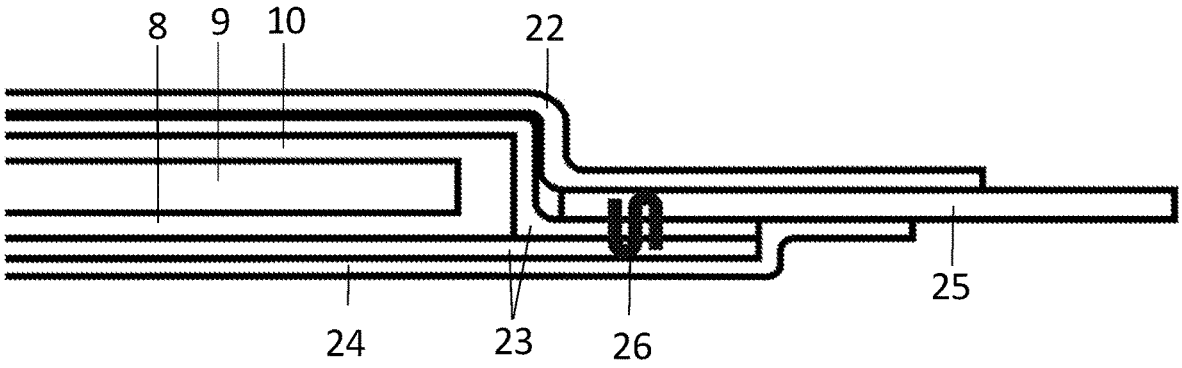
FIG. 20 is a cross section view of an exemplary layered design with integrated strap.

The outer layer 22, the layer furthest from the head while in use, can provide the aesthetic of the helmet and can incorporate a visor 4 and/or additional aesthetic details. In addition, the outer layer 22 can be comprised of selected material and/or perforation patterns that may provide ventilation for comfort, aerodynamics for performance, or material for aesthetic appeal. The outer layer 22 can also house passive or active powered electronic systems for identification and monitoring applications. FIG. 20 is a side view of the cross section of the layered design with integrated strap 25. The strap 25 can be integrated permanently into the other layers, such as the outer layer 22, the middle layer 24, and/or the inner layer 23. The integrated strap 25 can be integrated into the layers by stitching 26, fusing, or another permanent or semi-permanent method. Alternatively, the interchangeable strap 25 can attach to the layers by any non-permanent method, including snap-lock buttons, buckles, and any other method that is strong enough for the retention system to pass any regulations and to function properly.

The layered design of the helmet offers the opportunity to include electronic systems for identification and monitoring applications. A possible application includes implementing radio frequency identification, RFID, technology into the outer layer of the helmet. The RFID tag may be small enough to not significantly affect the protection of the helmet, and can provide easy identification and access for users. For example, skiiers and snowboarders could have the RFID tag easily grant them access to ski lifts without having to place a tag on them and show it to the receiver for access. Another possibility is to have the RFID implemented into cycling helmets that could be used as the key to access rideshare program bikes. The applied RFID technology provides ease of access for the user since the tag is always available, and provides an incentive for ski slope operators and rideshare program owners to incentivize helmet use for safety and liability concerns. Other electronic system applications include integrating monitoring systems into the outer layer 22 to monitor for impacts to alert emergency services, and/or integrating monitoring systems in the inner layer 24 to record trauma levels to assist with medical diagnosis.

Figure 21:
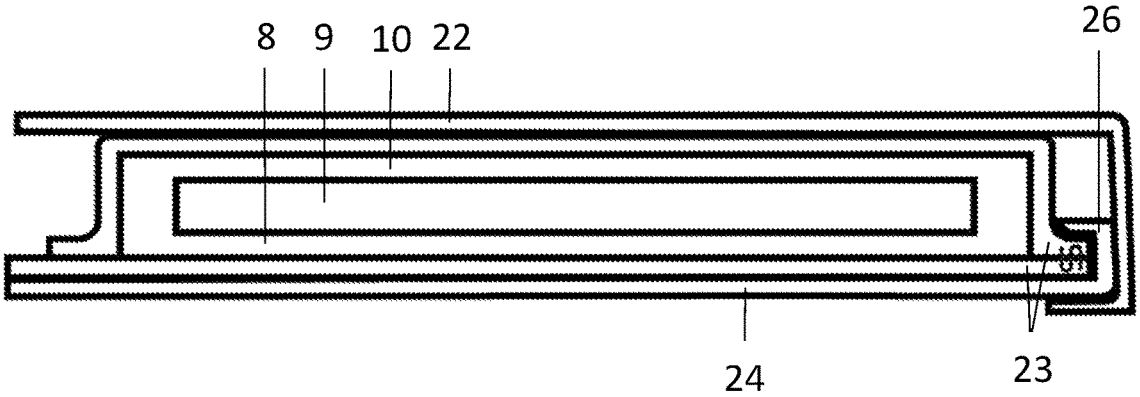
FIG. 21 is a cross section of exemplary layers around the edge of the helmet.

In addition, the layers may include a material with a low coefficient of friction to allow the layers to slide on top of each other. Materials with a low coefficient of friction may include but are not limited to woven fabrics, such as woven fabrics with PTFE, and coatings. This sliding effect allows the layers to "slip" and reduce the frictional effect on the helmet in the event of an impact, which can reduce the rotational energy experienced by the user during an impact. The present technology can offer improved comfort, ventilation, convenience, style, hygiene, and protection when compared to conventional helmets. The proposed technology can be customized to fit the user's taste and lifestyle so that there is no longer an excuse to not wear a helmet FIG. 21 is a side view of the cross section of the edge of the layers that runs along the bottom of the helmet. The inner layer 24 wraps around the middle layer 23 by either tension within the elastic fabric or a hard-plastic edge that runs around the bottom of the layer to hook the two layers together. Similarly, the outer layer 22 can wrap around the inner layer 22 or the middle layer 23 if the inner layer 22 is not present. The outer layer 22 can wrap around by either tension of the elastic material of a hard-plastic edge that runs around the bottom of the layer to hook the two layers together. This method of connecting the layers together allows for a seamless aesthetic with layers that can be easily placed on and taken off without any tools and possibly no assistance, creating an enjoyable user experience that invites the user to engage with the helmet for easy customization.

Figure 22:
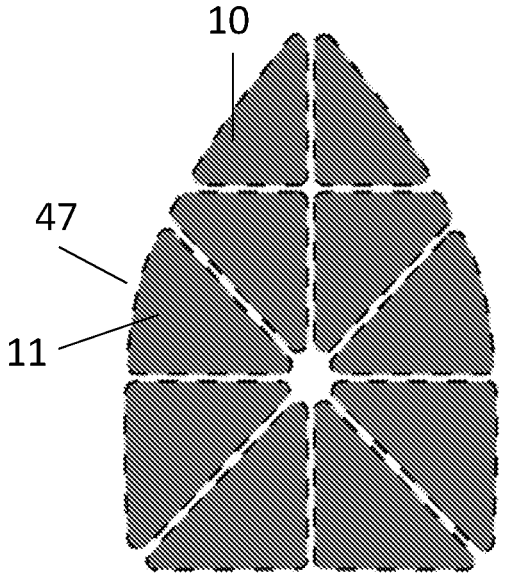
FIG. 22 is the top view of an exemplary panel of the middle layer for a six-panel style helmet.
Figure 24:
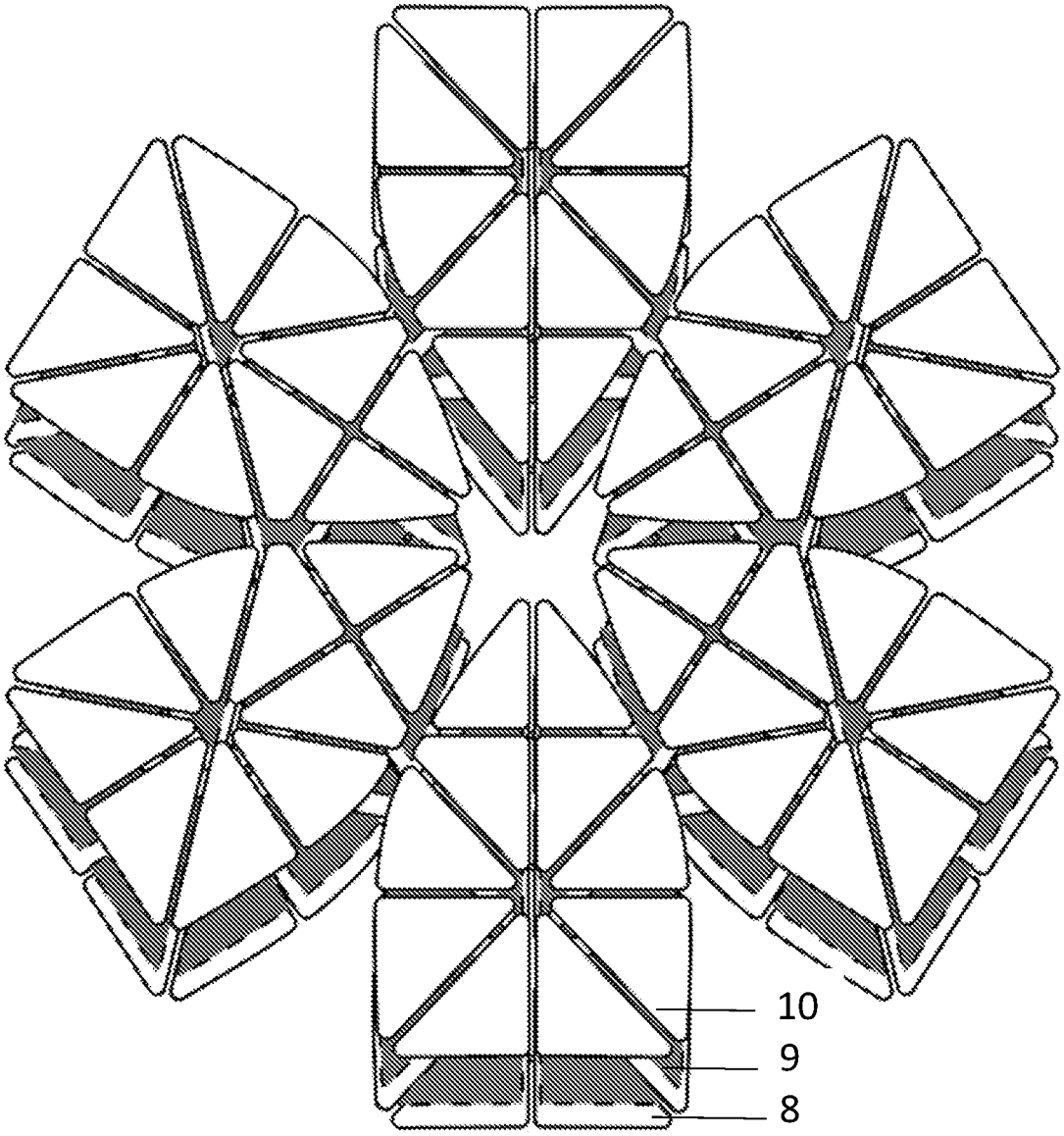
FIG. 24 is an exploded view of the middle layer of an exemplary six-panel style helmet.

FIG. 22 is a top view of one panel of the impact layer 9 for a six-panel style helmet, and represents a possible cutting pattern for the impact layer 9. The helmet 2 can include a number of panels that are attached by sewing, fusion, or another binding method. From this figure it is evident that a substantially triangular tile 11 may have at least one edge 47 that is slightly curved. A curved edge may allow for adjacent panels to conform to a desired three-dimensional geometry, such as a helmet as illustrated in FIGS. 24 and 25.

Figure 23:
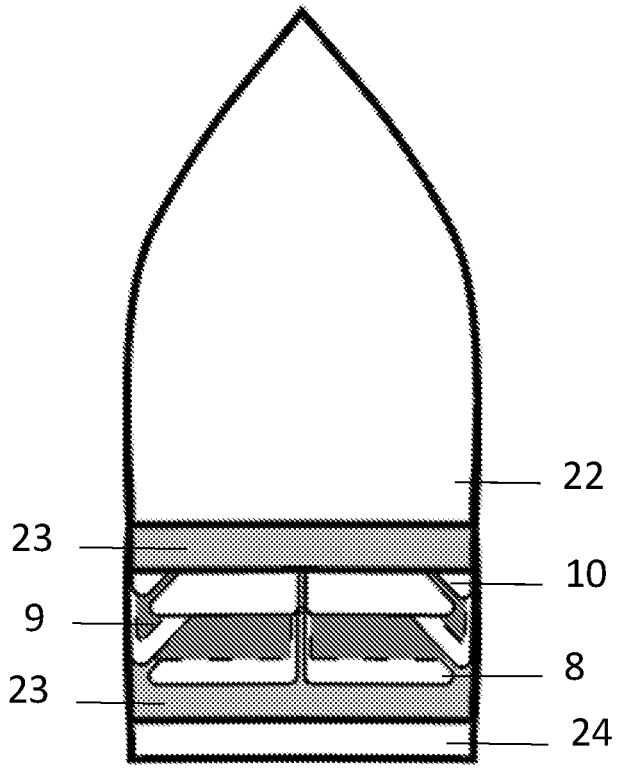
FIG. 23 is an exploded view of an exemplary panel of the inner layer, middle layer, and outer layer for a six-panel style helmet.

FIG. 23 is an exploded view of one panel of the inner layer 24, middle layer 23, and outer layer 22 for a six panel style helmet. The panel includes a layer for the impact tile base 8, impact layer 9, and the impact tile top 10. The combined six panels each form all of the layers for the three layered helmet example. FIG. 24 is an exploded view of the middle layer 23 of the six-panel style helmet, and shows all six panels that would be needed to form the helmet 2.

Figure 25:
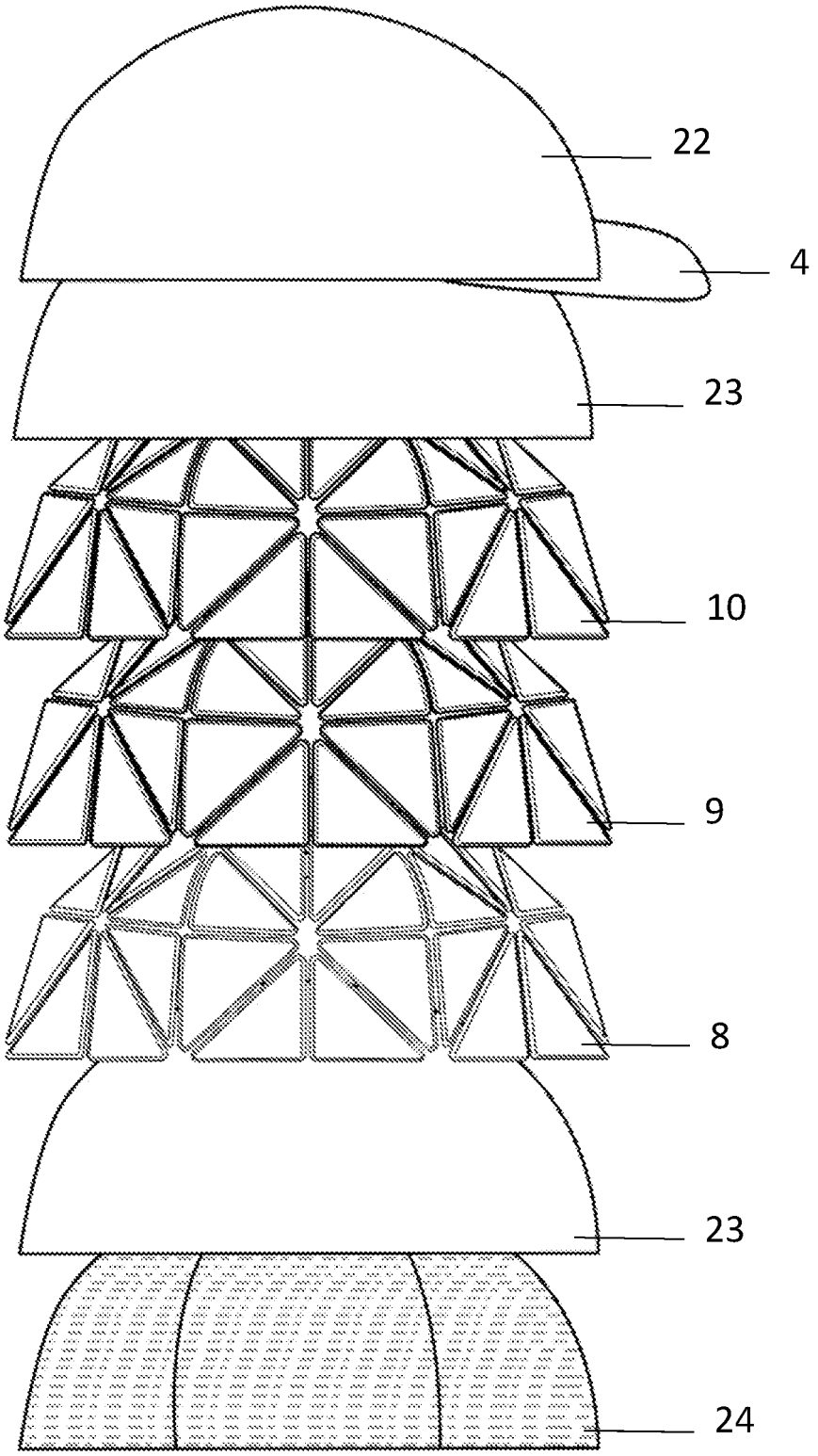
FIG. 25 is an exploded view of the inner, middle, and outer layer of an exemplary 6-panel style helmet, according to an example of the present technology.

FIG. 25 is an exploded view of the inner layer 24, middle layer 23, and outer layer 22 of the six-panel style helmet, including the impact tile base 8, impact layer 9, and impact tile top 10. The present technology can offer an improved user experience with improved comfort, ventilation, convenience, style, and hygiene when compared to conventional helmets with uncompromised protection. The present technology can be customized to fit the user's taste and lifestyle so that there is no longer an excuse to not wear a helmet.

Figure 26:
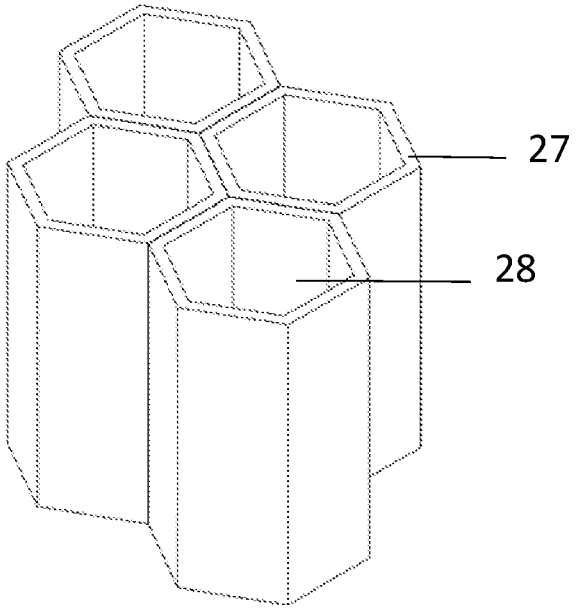
FIG. 26 is a perspective view of an exemplary array of impact attenuation structures with a hexagonal-like geometry.

FIG. 26 is a perspective view of an array of honeycomb 27 with a hexagonal-like geometry, and the size and shape of the honeycomb structure 27 will vary depending on the application. The cell size 28 and the specific cell shape will depend upon the material selected, manufacturing process, and application. The honeycomb material includes a plurality of cells, each of the cells including walls surrounding a central opening, and the walls extending parallel to the thickness. Many honeycomb structures consist of fiber materials, such as aramid fiber, that must be adhered, or bound, together with an impregnated resin. Many aramid fiber honeycombs rely upon a phenolic resin as a binding agent, and the aramid fiber and phenolic resin are hydrophilic. Likewise, many metallic honeycomb structures can be susceptible to environmental effects diminishing the structural integrity. When the structure is in the presence of moisture, the integrity of the structure can be degraded. This has often prevented fiber honeycombs from being applied to many environmental conditions, including those in harsh industrial, ecological, and/or consumer applications. For example, hydrophilic honeycomb may structurally degrade when applied to structures that are exposed to the weather. Similarly, hydrophilic honeycomb would not be suitable for personal protective equipment if it is exposed to the sweat of the user. FIG. 26 is simply a generic honeycomb to provide context for the alternative honeycomb provided in subsequent figures.

Figure 27:
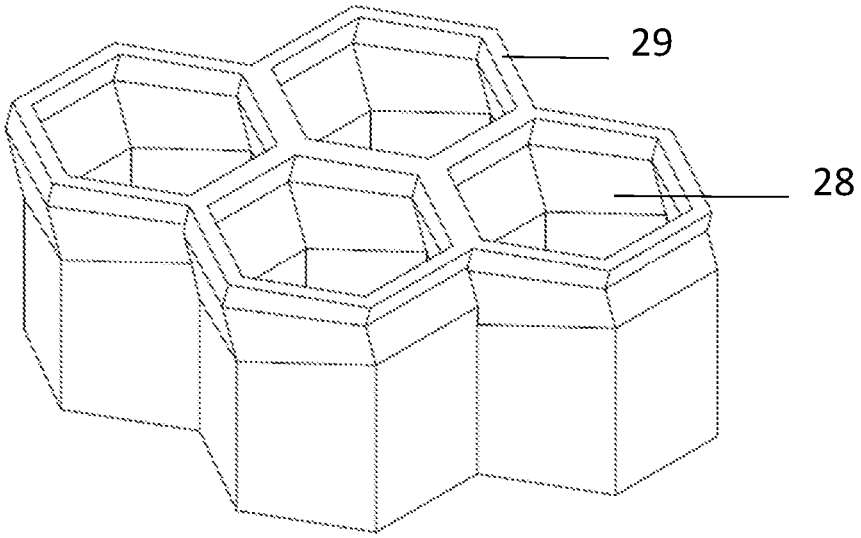
FIG. 27 is a perspective view of an exemplary array of prestressed impact attenuation structures with a hexagonal-like geometry.

FIG. 27 is a perspective view of an array of prestressed honeycomb 29 with a hexagonal-like geometry, and the size and shape of the honeycomb structure 29 will vary depending on the application. The cell size 28 and the specific cell shape will depend upon the material selected, manufacturing process, and application. Many honeycomb structures are often processed by being slightly crushed before being implemented, referred to as "prestressed" honeycomb. This process removes the initial amount of force required to begin buckling the honeycomb columns, and the amount of force applied and the buckling that occurs is dependent upon the specific application. For example, an aramid fiber may be prestressed only slightly to initiate buckling without applying too much stress to reduce the impact attenuation. The amount of force required to initiate buckling can be undesired in certain applications, such as impact attenuation. During an impact, the amount of force to initiate buckling can cause a rapid deceleration before the honeycomb buckles and deforms. The rapid deacceleration can cause a sudden acceleration, or impulse, that could be dangerous in applications such as spacecraft landing systems and protective helmets. The prestressed honeycomb allows for the honeycomb to consistently deform without having to first initiate buckling, effectively avoiding the sudden deacceleration or jolt during impact. The prestressing process often involves a flat surface that applies a uniform force to the top surface of the honeycomb to induce a uniform buckling across the honeycomb structure. Without the required force to initiate buckling, the prestressed honeycomb 29 will deform under load. This can be a problem for handling the prestressed honeycomb 29 since many forces encountered during handling can cause the prestressed honeycomb 29 to deform, resulting in a diminished amount of energy attenuation. FIG. 27 is simply a generic prestressed honeycomb to provide context for the alternative honeycomb provided in FIG. 28 and FIG. 29.

Figure 28:
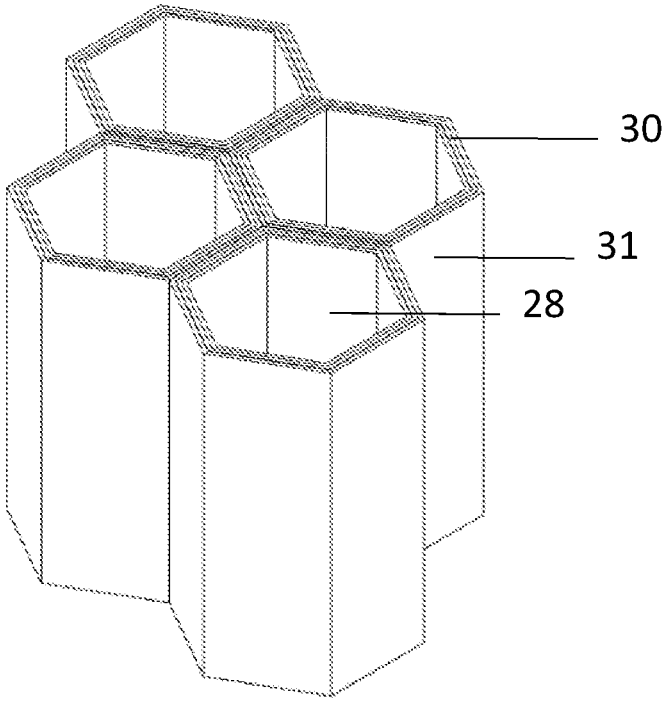
FIG. 28 is a perspective view of an exemplary array of coated impact attenuation structures with a hexagonal-like geometry.

FIG. 28 is a perspective view of an array of coated honeycomb 30 with a hexagonal-like geometry, and the size and shape of the honeycomb structure 30 will vary depending on the application. Certain applications, such as impact attenuation for large structures could require cell diameters to be a few inches with thick cell walls, while smaller impact attenuation sites may require cell sizes of a few millimeters and wall thicknesses of less than a meter. The cell size 28 and the specific cell shape will depend upon the material selected, manufacturing process, and application. The coated honeycomb 30 is covered in a hydrophobic material 31, such as polycarbonate or polypropylene. The hydrophobic material 31 forms a rigid coating that can act as a binding agent, similar to a phenolic resin, or just coat a bound honeycomb. A complete coating of the hydrophobic coating 31 to the hydrophilic honeycomb 30 would prevent moisture from interfacing with the aramid honeycomb, therefore preventing degradation of the honeycomb. The hydrophobic coating 31 can be applied by dipping the honeycomb structures into a pool of the liquid substance. Alternatively, spraying the liquid substance onto the honeycomb may be possible. The proposed technology includes a hydrophobic coating 31 for honeycomb structures 30 to allow for previously hydrophilic honeycomb 27 structures to be applied to a greater range of applications.

Figure 29:
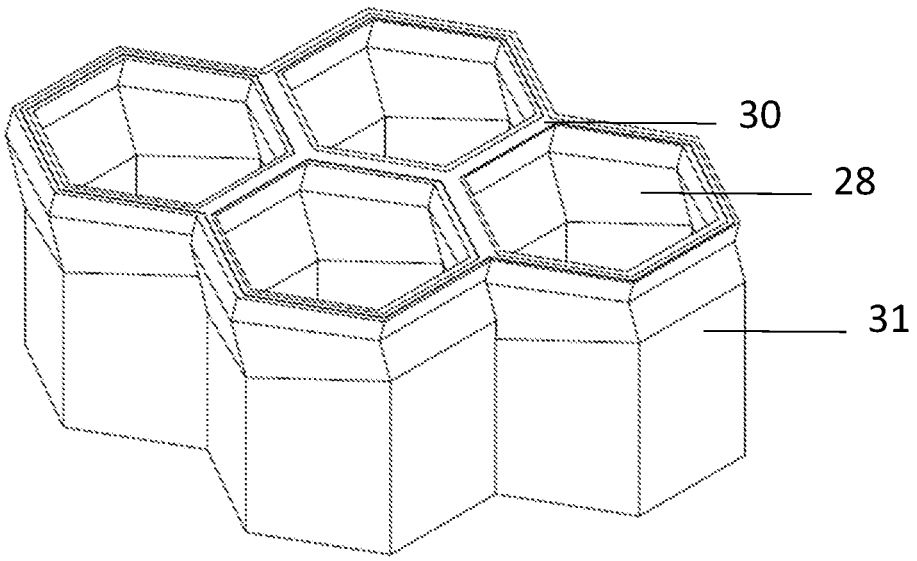
FIG. 29 is a perspective view of an exemplary array of coated prestressed impact attenuation structures with a hexagonal-like geometry.

FIG. 29 is a perspective view of an array of coated prestressed honeycomb 30 with a hexagonal-like geometry, and the size and shape of the honeycomb structure 30 will vary depending on the application. The cell size 28 and the specific cell shape will depend upon the material selected, manufacturing process, and application. The coated prestressed honeycomb 30 is covered in a hydrophobic material 31 such as polycarbonate or polypropylene. The hydrophobic material 31 can prevent moisture from interacting with the material, thus preventing degradation of the hydrophilic prestressed honeycomb 29. The prestressed honeycomb 29 is capable of deforming from minor forces, such as those encountered from handling the material, which can reduce the impact attenuation of the structure. The present technology features a rigid hydrophobic coating 31 on the honeycomb that prevents deformation from minor forces. The thin coating has a minimal yield strength that does not interfere with the objective of reducing peak acceleration before buckling. In previous applications, fiber honeycomb has been restricted to a narrow range of applications with reliability concerns due to the hydrophilic material property and delicate nature of pre-crushed honeycomb. The present technology allows for hydrophilic honeycombs to be treated with a hydrophobic substance to allow for the honeycomb to be applied to wider range of applications while maintaining the structural integrity during handling and while in use.

Figure 30:
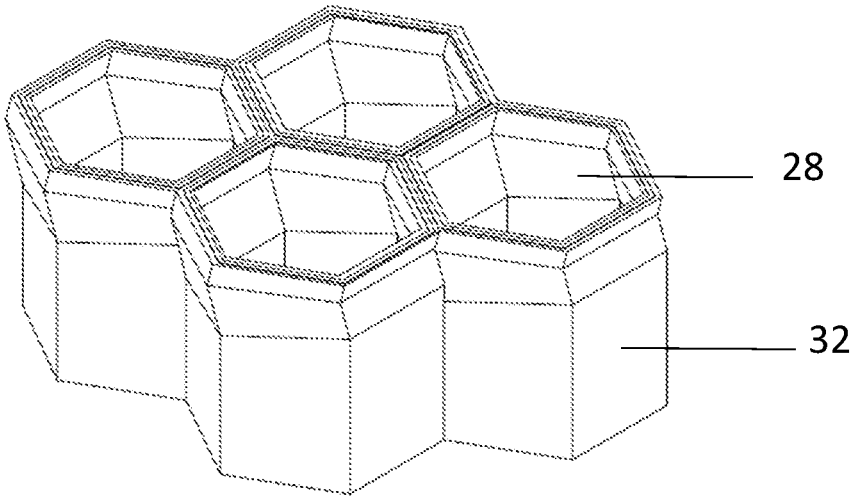
FIG. 30 is a perspective view of an exemplary array of binding coated impact attenuation structures with a hexagonal-like geometry.

FIG. 30 is a perspective view of an array of a binding coated prestressed honeycomb 32 with a hexagonal-like geometry, and the size and shape of the honeycomb structure 32 will vary depending on the application. The cell size 28 and the specific cell shape will depend upon the material selected, manufacturing process, and application. The coated prestressed honeycomb 32 is covered in a hydrophobic material 31 such as polycarbonate or polypropylene. The hydrophobic material 31 can prevent moisture from interacting with the material, thus preventing degradation of the hydrophilic prestressed honeycomb 29. In addition, the hydrophobic coating can act as a binding agent by binding the two honeycomb cells together, as shown by the separated hydrophobic cells. The present technology allows for hydrophilic honeycombs to be treated with a hydrophobic substance to allow for a wider range of applications and to act as a binding agent to bind the cells together.

Figure 31:
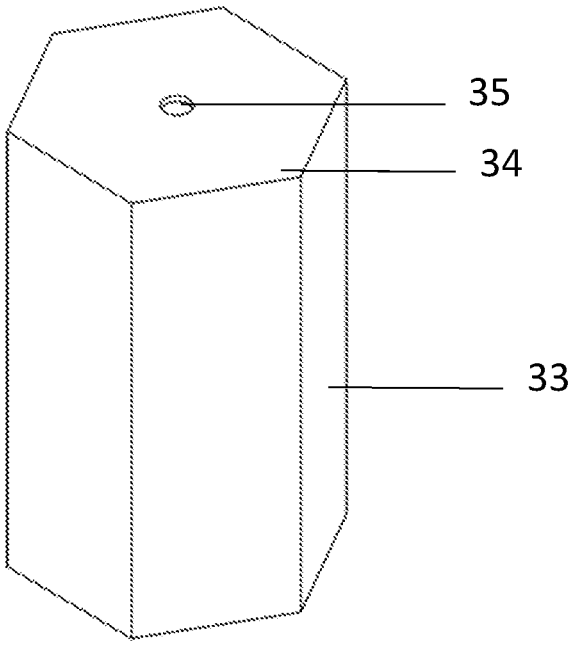
FIG. 31 is a perspective view of an exemplary impact attenuation structure with a covered top and bottom with a small orifice.

The present technology includes a honeycomb structure 33 that can adaptively respond to the energy of impacts. The honeycomb structure 33 includes a sealed panel 34 on the top and on the bottom (bottom portion not shown in FIG. 31) of the honeycomb ends. FIG. 31 shows a honeycomb cell 33 with a sealed panel 34 on the top and bottom with a single or multiple perforation(s) 35 that may be on the top, bottom, or both. The perforation 35, or orifice 35, may allow for the movement of fluid due to a change in inner volume of the structure from an impact crumpling and locally buckling the structure 33. The fluid inside the cell 33, can be Newtonian or non-Newtonian, responds to the change in volume of the cells with the relative impact velocity and corresponding kinetic energy as the fluid exits the orifice(s). Integration of the force transmitted on the exterior of the impact structure 33 through the stroke of relative displacement between either side of the impact structure 33 gives the impact energy absorbed through elastic and plastic deformation during the deceleration. Mitigation of the trauma due to impacts is highly sensitive to time integrated and time weighted peak acceleration, meaning a flat/constant deceleration over the longest distance provides the greatest protection against traumatic injuries, such as those experienced in cycling accidents.

Current materials like EPS are slightly adaptive to strain-rates but that is highly coupled to the materials density which is also highly coupled to the nominal low strain rate force versus strain nominal curve for slow impacts. The coupling disallows someone from fully optimizing the adaptive attenuative effect for the perfect deceleration given the specific impact. These adaptive effects are from micro fluid dynamic effects of the air pockets in the material and shock wave dissipation not intentionally added when EPS was first used in helmets. But in the honeycomb cell design, the accidental air pocket effect of the EPS to adaptively respond to impacts can be controlled by an orifice on each of the honeycomb cells encasing the EPS. The faster the attenuation, the faster the liquid or gas inside of the cells is pushed out and the more corresponding energy the gas and liquid has, thus creating an optimal deceleration curve for a given impact energy. The impact is now adaptive, controlled by the ratio of the cell cross-sectional area to the ratio of the orifice areas. Structurally, the orifices are problematic at the ends of the cell because of difficulty in routing the exhaust gas of an impact adaptive cell at the surface of impact and need of a standoff structure and because inducing pressure differentials between cells hinders structural buckling properties as the pressurized cells will buckle into the non-pressurized cells. However, when the orifice holes are on the walls between tubes, a collective area pressurization will occur and less gage pressure between the cells will less adversely affect structural buckling and improve the collective cell array response to localized cell impacts not well distributed across cells.

Figure 32:
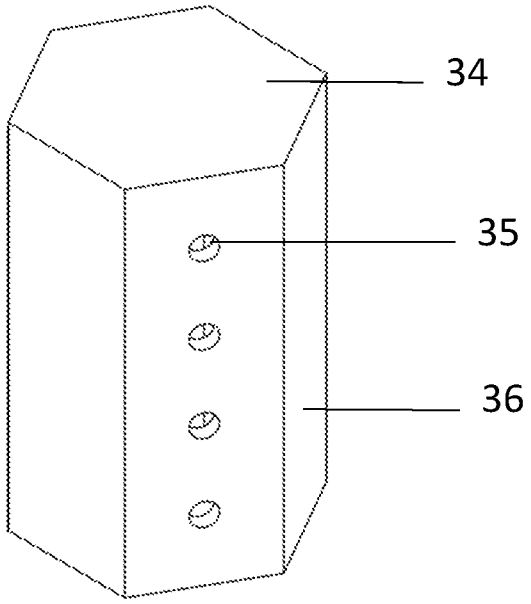
FIG. 32 is a perspective view of an exemplary impact attenuation structure with a covered top and bottom with a series of perforations along the cell wall.

The proposed technology shown in FIG. 32 shows the honeycomb structure 36 including panels 34 on the top and bottom with perforations 35 along the cell wall 36 of the structure. The perforations 35 along the cell wall of the honeycomb 34 also create stress riders that provide weak spots during loading, which may allow for a way to predict and control the buckling response, an inherently unpredictable behavior.

Figure 33:
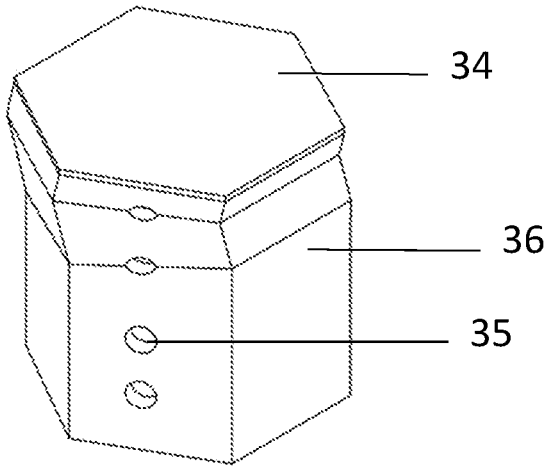
FIG. 33 is a perspective view of an exemplary partially crushed impact attenuation structure with a covered top and bottom with a series of perforations along the cell wall.
Figure 34:
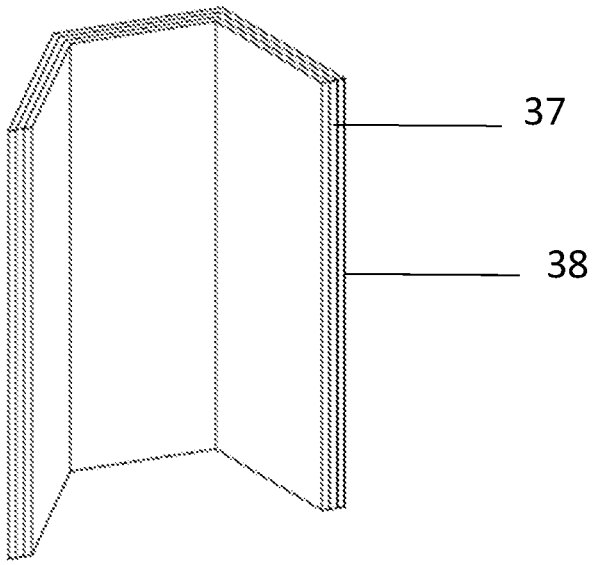
FIG. 34 is a perspective view of the cross section of an exemplary impact attenuation structure with a composite cell wall.
Figure 35:
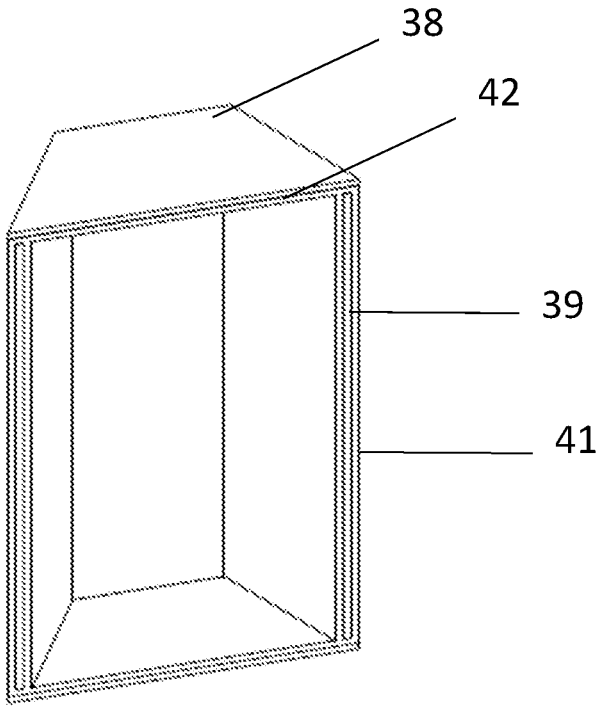
FIG. 35 is a perspective view of the cross section of an exemplary impact attenuation structure with a thermally adhered composite panel.
Figure 36:
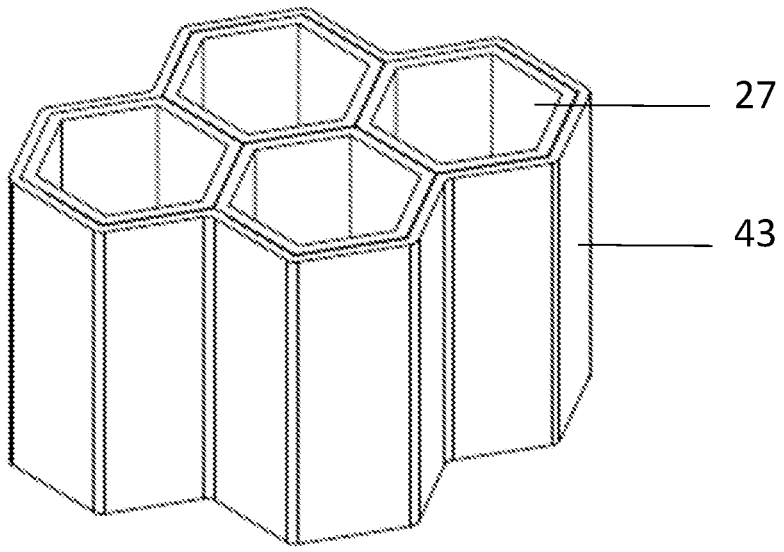
FIG. 36 is a perspective view of an exemplary oblique impact reinforced impact attenuation structure.

The proposed technology shown in FIG. 33 shows the honeycomb structure 36 including panels 34 on the top and bottom with perforations 35 along the cell wall 36 of the partially crushed structure. As the honeycomb structure 36 is crushed, the pressurized cell may allow for an adaptive impact response through the stroke. This is similar to FIG. 32 above, for the faster the liquid or gas inside the cells is pushed out the more corresponding energy is contained in the escaping gas and liquid. The impact response is controlled by the ratio of the cell cross-sectional area to the ratio of the orifice areas. However, the proposed technology in FIG. 33 differs from the previously mentioned technology since the structure 36 may allow for a changing orifice 35 area with relation to the portion of the cell 36 that is crushed. During the crushing process, the orifice that is activating the buckling due to the orifice being a local stress riser will close as the surrounding cell wall area collapses in on the opening, thus closing the orifice 35.

Multiple perforations 35 along a cell wall 36 compensate for the adverse decrease in impact force by closing off some orifices as buckling propagates through the cell and closes orifices one at a time. When each consecutive orifice closes, the collective orifice area decreases, thereby increasing the energy and speed of the exhausted fluid, stiffening slightly the air adaptive effect and compensating for the effect decreasing as a helmet decelerates. In the circumstance that the buckling attenuative honeycomb does not progressively buckle and instead globally buckles simultaneously, each orifice is set at a location that becomes more hindered over time for exhaustive gas, in which case the orifice effectively closes more and more while the cell buckles, decreasing the corrected orifice cross sectional area and maintaining a more constant inner pressure to each cell.

The present technology includes a honeycomb structure with a cell wall 36 including a series of layers with varying densities. The honeycomb can include various materials, such as metals, fibers, and thermoplastics. A thermoplastic, for example, would be produced through a multi-layer extrusion process where the layers of the cell walls are extruded together to form a honeycomb structure. The layers can have different densities, allowing one of the layers, such as the middle layer 37 of three layers to be a less dense material that acts as a stand-off for the outer layers 38, similar to how composite carbon fiber panels are stood off from one another to increase bending stiffness. The outside layers 38 of the cell wall provide a significant portion of the strength of the structure during load, deformation strain and energy absorption because they are geometrically set at the ends of the cross section that undergoes more deformation per panel strain radius and while the less dense core material in the middle reduces the overall weight of the structure that would otherwise not significantly contribute to strain energy absorption. Ultimately, a significant portion of the honeycomb structure strength deformation energy potential is maintained or improved with the possibility of significantly reducing the overall structure weight.

The present technology includes a honeycomb structure 36 with a manipulated cell wall to improve the impact response of a honeycomb cell during buckling. The cell wall 36 can have a varying density or thickness throughout the length of the cell wall. Metal honeycombs are produced by a crimping method that crimps the metal ribbon and then the metal ribbon is bonded together in the appropriate shape to form a honeycomb structure. The metal ribbon could have a varying thickness or density for various lengths and/or widths of the ribbon that is then formed into the cell wall. Thermoplastic honeycombs are often produced in an extrusion process, and the thickness and/or density of the cell wall is determined by certain parameters of the extrusion including the material, extrusion rate, extrusion force/pressure, and heat. The density and thickness could be varied as the honeycomb cells 36 are extruded from the die and then the extrusion is cut to proper sheet thickness. An application could have a very thin top portion of the honeycomb with a thicker portion below it. The thinner portion would buckle before the thicker portion, providing a controlled and predictable buckling to reducing rebound elastic energy and optimizing across various impact energies. Buckling would be initiated earlier by having the top portion immediately buckle, reducing the peak acceleration that occurs as the result of applying load until critical buckling occurs, while the remaining thicker structure can provide the remaining impact attenuation. While extruding slow enough, one may control the temperature to a large degree and cool the honeycomb as it is extruded. This may cold work the material more and more inducing residual stresses the colder the honeycomb is extruded towards the end to make the cell unstable and prone to buckling to reduce the stress riser from a first critical buckle and eliminate the need for pre-crushing of the honeycomb.

The present technology includes a composite panel that is thermally adhered to the top and/or bottom of an individual honeycomb cell or a plurality of honeycomb cells. The composite panel and the honeycomb cell walls can include a series of layers of thermoplastic material. The current method is to rely upon an adhesive that bonds the panel to the cell, but this is not always reliable and does not always create a strong seal. The present technology includes selecting the proper thermoplastic materials with the proper effective melting points and densities to ensure a proper bond. The core 39 of the honeycomb preferably has the highest melting point to ensure proper structure integrity, as well as the core of the composite panel 40. The cell wall outside layer 41 needs to have a lower melting point than the panel core 40 but a higher melting point than the panel outside layer 42. With this ordering, the panel and honeycomb cell wall will maintain structural integrity through the thermal bonding process, while the outside layers of the wall and panel will melt and bond with the application of heat, creating an effective bond. A suggested manufacturing includes having the composite sheet underneath the honeycomb so that during the bonding process, the panel outer layer 42 softens to allow the honeycomb cell walls to sink into the panel outer layer 42 creating a meniscus effect and improving the bond in a way that is more reliable and predictable when compared to bonding with the panel on top.

The proposed technology includes a reinforcement structure 43 applied to single honeycomb cell or an array of honeycomb cells 27 to optimize the impact response from an oblique impact. The reinforcement 43 can include an open or closed cell foam, thermoset plastic, non-Newtonian fluid, or similar material that is applied, in effect surrounding, a single honeycomb cell, around an array of cells, or injected within certain cells of an array. Impact attenuation structures such as honeycomb cells, which have a columnar shape, have the optimal response to a force when the force is applied normal to the top surface of the cells and distributed evenly across the array of cells. The cells then critically buckle with the appropriate force, and the cell walls buckle to provide impact attenuation by means of non-rebounding constant force over a given distance. In the event of an oblique impact, a certain portion of the impact is not applied normal to the top of the cell or well distributed across cells, which may greatly diminish the impact absorption of the structure since it will buckle sub-optimally and less of the array will be engaged in buckling. The proposed technology includes applying the reinforcing material to attenuate the non-normal force that is at a higher stiffness and more isotropically load direction agnostic, as concentrated and not normally directed as that load may be, while the honeycomb can attenuate the normal load, providing the optimal loading situation and optimizing the impact attenuation of the structure.

While the present technology has been described in connection with several practical examples, it is to be understood that the technology is not to be limited to the disclosed examples, but on the contrary, is intended to cover various modifications and equivalent arrangements included within the spirit and scope of the technology.

The invention claimed is:

1. A helmet comprising:

a plurality of tiles configured to absorb impact, each of the tiles including an impact absorbing material with a profile with at least three sides and including a thickness, each of the at least three sides including a respective straight portion;

a plurality of connections that are flexible; and another material covering the at least three sides to be between one of the at least three sides and another immediately adjacent one of the at least three sides of another of the tiles and extending from the at least three sides around an edge of and over a face of the impact absorbing material to be transverse to the at least three sides, wherein each of the plurality of tiles is connected to another immediately adjacent one of the plurality of tiles by one of the plurality of connections at the respective straight portion such that each of the plurality of connections is configured to bend along a respective direction determined by the respective straight portion of immediately adjacent tiles, the plurality of tiles and the plurality of connections are arranged to form a plurality of panels, each of the plurality of panels including more than one of the plurality of tiles and more than one of the plurality of connections, the plurality of tiles and the plurality of connections are configured so that the helmet is repeatably changeable from a first configuration to a second configuration, the first configuration is shaped to be worn on a user's head with the thickness normal to the user's head and the face of the impact absorbing material facing away from the user's head, and the second configuration is at least partially collapsed to a shape smaller than the first configuration.

2. The helmet according to claim 1, wherein the helmet is substantially cylindrical in the second configuration.

3. The helmet according to claim 1, wherein the plurality of connections are elastic.

4. The helmet according to claim 1, wherein the plurality of connections are inelastic.

5. The helmet according to claim 1, wherein the profile is a triangle with rounded vertexes.

6. The helmet according to claim 1, wherein each of the plurality of tiles includes, within the thickness, a base layer, a top layer and an impact absorbing layer between the base layer and the top layer.

7. The helmet according to claim 6, further comprising a rotation layer between the top layer and the impact absorbing layer, wherein the rotation layer is configured to allow relative rotation between the top layer and the impact absorbing layer.

8. The helmet according to claim 7, wherein the relative rotation is a limited amount of relative rotation.

9. The helmet according to claim 7, wherein the rotation layer includes a socket and the top layer includes a ball that together form a ball and socket joint.

10. The helmet according to claim 1, wherein the impact absorbing material is a honeycomb material.

11. The helmet according to claim 10, wherein the honeycomb material includes a plurality of cells, each of the cells including walls surrounding a central opening, and the walls extend parallel to the thickness.

12. The helmet according to claim 1, further comprising an inner layer and an outer layer that sandwich the plurality of tiles.

13. The helmet according to claim 12, wherein at least one of the inner layer and the outer layer is configured to slip relative to the plurality of tiles during an impact transverse to the thickness.

14. The helmet according to claim 1, wherein the plurality of tiles are arranged such that each of the plurality of connections corresponds to a gap between two respective ones of the tiles at the respective straight portions and a cross-section of each of the gaps is consistent where the respective straight portions are immediately adjacent.

15. The helmet according to claim 1, wherein the impact absorbing material is a honeycomb and the other material is an impact attenuation material different from the honeycomb.

16. The helmet according to claim 15, wherein the other material is bonded to the impact absorbing material.

17. The helmet according to claim 1, wherein the other material is bonded to the impact absorbing material.

* * * * *